US012313059B2

(12) United States Patent
Cui et al.

(10) Patent No.: US 12,313,059 B2
(45) Date of Patent: May 27, 2025

(54) VARIABLE-SPEED INTEGRATED MACHINE AND WELLSITE APPARATUS

(71) Applicant: YANTAI JEREH PETROLEUM EQUIPMENT & TECHNOLOGIES CO., LTD., Shandong (CN)

(72) Inventors: Shuzhen Cui, Shandong (CN); Rikui Zhang, Shandong (CN); Sheng Chang, Shandong (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 169 days.

(21) Appl. No.: 17/559,522

(22) Filed: Dec. 22, 2021

(65) Prior Publication Data

US 2022/0112892 A1 Apr. 14, 2022

Related U.S. Application Data

(63) Continuation-in-part of application No. PCT/CN2019/114303, filed on Oct. 30, 2019.

(30) Foreign Application Priority Data

Aug. 23, 2021 (WO) ..... PCT/CN2021/113988

(51) Int. Cl.
*F04B 53/08* (2006.01)
*E21B 43/26* (2006.01)
(Continued)

(52) U.S. Cl.
CPC ..... *F04B 53/08* (2013.01); *E21B 43/2607* (2020.05); *F04B 17/03* (2013.01); *F04B 53/16* (2013.01); *F04D 25/06* (2013.01)

(58) Field of Classification Search
CPC ..... F04B 17/03; F04B 25/06; F04B 53/08; F04B 53/16; E21B 43/2607
See application file for complete search history.

(56) References Cited

U.S. PATENT DOCUMENTS 3,053,163 A * 9/1962 Schofield ..... B60H 1/00007 165/44
3,794,377 A 2/1974 Wachsmuth et al.
(Continued)

FOREIGN PATENT DOCUMENTS

CA 2900387 A1 10/2012
CN 100999188 A 12/2006
(Continued)

OTHER PUBLICATIONS

English Translation of CN 210273758 U (Year: 2020).*
(Continued)

*Primary Examiner* — Connor J Tremarche
(74) *Attorney, Agent, or Firm* — Sheppard Mullin Richter & Hampton LLP

(57) ABSTRACT

A variable-speed integrated machine and a wellsite apparatus are disclosed. The variable-speed integrated machine includes: a driving device which includes an electric motor and a housing; an inversion device which is disposed on the housing and electrically connected with the electric motor; an inversion heat dissipating device which is disposed at one side of the inversion device away from the housing and configured to perform heat dissipation on the inversion device in a liquid-cooling heat dissipating way; and a driving heat dissipating device, at least one portion of the driving heat dissipating device being disposed on the housing and configured to perform heat dissipation on the driving device in at least one selected from the group of a liquid-cooling heat dissipating way and an air-cooling heat dissi-
(Continued)

pating way, the inversion device and at least one portion of the driving heat dissipating device are disposed on a same side of the housing.

18 Claims, 19 Drawing Sheets

(51) Int. Cl.
*F04B 17/03* (2006.01)
*F04B 53/16* (2006.01)
*F04D 25/06* (2006.01)

(56) References Cited

U.S. PATENT DOCUMENTS 3,815,965 A 6/1974 Ostwald
4,201,523 A 5/1980 Olofsson
4,793,775 A 12/1988 Peruzzi
4,908,538 A * 3/1990 Geberth, Jr. ..... H02K 9/28 310/227
5,282,722 A 2/1994 Beatty
5,846,056 A 12/1998 Dhindsa et al.
6,134,878 A 10/2000 Amako et al.
7,036,310 B2 5/2006 Aoki et al.
7,708,538 B2 * 5/2010 Kawabata ..... F04C 23/00 417/313
8,731,793 B2 5/2014 Barbir et al.
8,937,415 B2 * 1/2015 Shimono ..... H02K 9/14 310/58
9,863,476 B2 * 1/2018 Gray ..... F16C 35/045
10,610,842 B2 4/2020 Chong
10,648,311 B2 5/2020 Oehring et al.
10,801,311 B1 10/2020 Cui et al.
10,865,624 B1 12/2020 Cui et al.
10,914,155 B2 2/2021 Oehring et al.
10,989,180 B2 4/2021 Yeung et al.
11,109,508 B1 8/2021 Yeung et al.
11,125,066 B1 9/2021 Yeung et al.
11,208,878 B2 12/2021 Oehring et al.
11,220,895 B1 1/2022 Yeung et al.
11,236,739 B2 2/2022 Yeung et al.
11,378,008 B2 7/2022 Yeung et al.
11,391,136 B2 7/2022 Coli et al.
11,434,737 B2 9/2022 Oehring et al.
11,459,863 B2 10/2022 Robinson et al.
11,530,602 B2 12/2022 Yeung et al.
11,578,580 B2 2/2023 Oehring et al.
11,629,584 B2 4/2023 Yeung et al.
11,859,482 B2 1/2024 Yeung et al.
11,982,169 B2 5/2024 Cui et al.
12,065,968 B2 8/2024 Yeung et al.
12,084,952 B2 9/2024 Robinson et al.
12,116,875 B2 10/2024 Oehring et al.
2003/0064858 A1 4/2003 Saeki et al.
2005/0093496 A1 5/2005 Tokunou et al.
2007/0273220 A1 * 11/2007 Koyama ..... H02K 9/14 310/58
2010/0135840 A1 6/2010 Fujimoto et al.
2011/0061411 A1 3/2011 Kim et al.
2013/0119832 A1 * 5/2013 Nagao ..... H02K 5/203 310/68 B
2013/0255153 A1 10/2013 Sasaki et al.
2013/0306322 A1 11/2013 Sanborn et al.
2014/0138079 A1 5/2014 Broussard et al.
2014/0219824 A1 8/2014 Burnette
2014/0239858 A1 * 8/2014 Bertotto ..... H02P 3/14 318/376
2016/0041066 A1 2/2016 Patenaude et al.
2016/0177675 A1 6/2016 Morris et al.
2016/0348479 A1 12/2016 Oehring et al.
2017/0051732 A1 2/2017 Hemandez et al.
2017/0285062 A1 10/2017 Kim
2017/0288565 A1 10/2017 Bethke et al.
2017/0292789 A1 10/2017 Hjorth et al.
2017/0302135 A1 10/2017 Cory
2018/0159403 A1 6/2018 Yokoyama et al.
2018/0326337 A1 * 11/2018 Esenwein ..... B01D 46/0005
2018/0328157 A1 11/2018 Bishop
2019/0010793 A1 1/2019 Hinderliter
2019/0100989 A1 4/2019 Stewart et al.
2019/0128265 A1 5/2019 Washio et al.
2019/0169971 A1 6/2019 Oehring et al.
2019/0195292 A1 6/2019 Pan et al.
2020/0040878 A1 2/2020 Morris
2020/0049136 A1 2/2020 Stephenson
2020/0109616 A1 4/2020 Oehring et al.
2020/0109617 A1 4/2020 Oehring et al.
2020/0300246 A1 * 9/2020 Sadakata ..... F04B 53/002
2020/0325760 A1 10/2020 Markham
2020/0378232 A1 12/2020 Sharp et al.
2021/0040830 A1 2/2021 Mu et al.
2021/0040836 A1 2/2021 Baskin
2021/0079902 A1 3/2021 Yeung et al.
2021/0095552 A1 4/2021 Oehring et al.
2021/0095648 A1 4/2021 Buckley et al.
2021/0102451 A1 4/2021 Robinson et al.
2021/0102530 A1 4/2021 Pruitt et al.
2021/0199161 A1 7/2021 Eto et al.
2021/0207588 A1 7/2021 Yeung et al.
2021/0310341 A1 10/2021 Sherman et al.
2022/0018232 A1 1/2022 Oehring et al.
2022/0112889 A1 4/2022 Yeung et al.
2022/0112892 A1 4/2022 Cui et al.
2022/0213777 A1 7/2022 Cui et al.
2022/0298906 A1 9/2022 Zhong et al.
2022/0364448 A1 11/2022 Oehring et al.
2023/0055844 A1 2/2023 Yeung et al.
2023/0146951 A1 5/2023 Robinson et al.
2023/0203927 A1 6/2023 Yeung et al.
2023/0272699 A1 8/2023 Oehring et al.
2023/0296050 A1 9/2023 Yeung et al.
2024/0084680 A1 3/2024 Robinson et al.
2024/0093583 A1 3/2024 Yeung et al.
2024/0295191 A1 9/2024 Yeung et al.
2024/0392666 A1 11/2024 Robinson et al.

FOREIGN PATENT DOCUMENTS

CN 201549965 U 8/2010
CN 102602322 A 7/2012
CN 105020343 A 11/2015
CN 109882144 A 4/2019
CN 208924123 U 5/2019
CN 110107490 A 8/2019
CN 110118127 A 8/2019
CN 110152552 A 8/2019
CN 110155193 A 8/2019
CN 110252191 A 9/2019
CN 110513097 A 11/2019
CN 210273758 U * 4/2020
CN 210889387 U 6/2020
CN 111799903 A 7/2020
CN 111525736 A 8/2020
CN 211201920 U 8/2020
CN 211530941 U 9/2020
CN 112383190 A 10/2020
CN 112127863 A 12/2020
CN 112311297 A 2/2021
CN 112467899 A 3/2021
CN 212649313 U 3/2021
CN 212749608 U 3/2021
CN 112983382 A 6/2021
CN 113513462 A 10/2021
CN 214330604 U 10/2021
CN 215292784 U 12/2021
CN 114109335 A 3/2022
CN 114553062 A 5/2022

(56) References Cited

FOREIGN PATENT DOCUMENTS

| | | | |
|---|---|---|---|
| JP | 4096267 | B2 | 5/2003 |
| WO | 2020139630 | A1 | 7/2020 |

OTHER PUBLICATIONS

Non-Final Office Action for U.S. Appl. No. 17/884,358 mailed on Dec. 8, 2022.
Final Office Action for U.S. Appl. No. 17/733,922 mailed on Dec. 28, 2022.
Notice of Allowance for U.S. Appl. No. 17/884,358 mailed on Feb. 8, 2023.
Written Opinion and International Search Report for PCT Application No. PCT/CN2021/113988 mailed on Apr. 28, 2022.
Written Opinion of the International Searching Authority and International Search Report for PCT Application No. PCT/CN2019/114303 mailed on Aug. 3, 2020.
"Kilowatts to horsepower conversion," RapidTables, retrieved from: https://www.rapidtables.com/convert/power/kw-to-hp.html—Kilowatts to horsepower (hp) conversion calculator, retrieved on May 6, 2020.
Quintuplex—PowerZone, retrieved from: https://www.powerzone.com/resources/glossary/quintuplex#:-:text=A%20reciprocating%20pump%20design%20which,pump%20used%20across%20many%20industries.&text=Dual%20action%20quintuplex%20pumps%20can,rare%20and%20usually%20custom%20manufactured, retrieved on Aug. 18, 2020.
Final Office Action for U.S. Appl. No. 16/833,496 mailed on Aug. 28, 2020.
Non-Final Office Action for U.S. Appl. No. 16/833,496 mailed on May 12, 2020.
Non-Final Office Action for U.S. Appl. No. 17/733,922 mailed on Sep. 21, 2022.
First Search Report for Chinese Application No. 202111198446.6 mailed on Mar. 15, 2023.
Search Report for Chinese Application No. 202111198446.6 mailed on May 25, 2023.
Written Opinion and International Search Report for PCT Application No. PCT/CN2022/101889 mailed on Sep. 7, 2022.
Non-Final Office Action for U.S. Appl. No. 18/360,678 mailed on Feb. 28, 2024.
First Search for Chinese Application No. 201911043619.X mailed on Feb. 1, 2024.
Second Office Action for Chinese Application No. 201911043619.X mailed on Jul. 31, 2024.
Office Action for Candian Application No. 3173692 mailed on Aug. 16, 2024.
Notice of Allowance for U.S. Appl. No. 18/360,678 mailed on Aug. 20, 2024.
Notice of Allowance for U.S. Appl. No. 18/311,042 mailed on Sep. 27, 2024.
Non-Final Office Action for U.S. Appl. No. 18/629,003 mailed on Oct. 7, 2024.
Rejection Decision for Chinese Application No. 201911043619.X mailed on Nov. 18, 2024.
Supplemental Search Report for Chinese Application No. 201911043619.X mailed on Nov. 5, 2024.
Feng et al., "Well Repair vol. 2", Nov. 30, 1988. English abstract provided.
Notice fo Allowance for U.S. Appl. No. 18/643,904 mailed on Feb. 4, 2025.
Notice of Allowance for U.S. Appl. No. 18/629,003 mailed on Feb. 20, 2025.
First Office Action for Chinese Application No. 202110864527.9 mailed on Dec. 24, 2025.

* cited by examiner

VARIABLE-SPEED INTEGRATED MACHINE AND WELLSITE APPARATUS

CROSS-REFERENCE OF RELATED APPLICATION

For all the purposes, the present application is a bypass continuation-in-part application of a PCT application PCT/CN/2019/114303 filed on Oct. 30, 2019 and claims priority to a PCT application PCT/CN2021/113988 filed on Aug. 23, 2021, the entire disclosure of which are incorporated herein by reference as part of the present application.

TECHNICAL FIELD

Embodiments of the present disclosure relate to a variable-speed integrated machine and a wellsite apparatus including the variable-speed integrated machine.

BACKGROUND

At present, multiple fracturing apparatus (for example, 10 to 30 fracturing apparatus) are generally used intensively on the fracturing site of oil and gas fields, which occupies a large area. In order to reduce the total number of the apparatus, more and more large power fracturing apparatus is used.

The large power fracturing apparatus mainly adopts two power driving ways, i.e. diesel-driven and electric-driven. For example, in the diesel-driven fracturing apparatus, a power source is a diesel engine, a transmission gear includes a gearbox and a transmission shaft, and an executing element is a piston pump. In the electric-driven fracturing apparatus, the power source is an electric motor, the transmission gear is a transmission shaft or a coupler, and the executing element is a piston pump.

SUMMARY

According to the first aspect of the present disclosure, it is provided a variable-speed integrated machine, comprising: a driving device, comprising an electric motor and a housing configured for accommodating the electric motor; an inversion device, disposed on the housing and electrically connected with the electric motor; an inversion heat dissipating device, disposed at one side of the inversion device away from the housing and configured to perform heat dissipation on the inversion device in a liquid-cooling heat dissipating way; a driving heat dissipating device, at least one portion of the driving heat dissipating device is disposed on the housing and configured to perform heat dissipation on the driving device in at least one selected from the group of a liquid-cooling heat dissipating way and an air-cooling heat dissipating way; wherein the inversion device and at least one portion of the driving heat dissipating device are disposed on a same side of the housing.

At least in some embodiments, the housing defines a cavity, the cavity is configured to accommodate the electric motor, the driving heat dissipating device comprises: an air-cooling heat dissipating mechanism, the air-cooling heat dissipating mechanism comprises an air-output assembly communicated with the cavity, and the air-output assembly and the inversion device are disposed on the same side of the housing.

At least in some embodiments, the air-cooling heat dissipating mechanism comprises at least two air-output assemblies, and the at least two air-output assemblies have same air-output direction or different air-output directions.

At least in some embodiments, the air-output assembly comprises: a heat dissipating fan, disposed on the housing; a fan volute, disposed between the heat dissipating fan and the housing; and an exhaust-air duct. A first side of the fan volute is communicated with the heat dissipating fan, a second side of the fan volute is communicated with the cavity, a third side of the fan volute is communicated with the exhaust-air duct, the electric motor comprises an output shaft, and the first side and the second side are opposite to each other in a direction perpendicular to the output shaft. The heat dissipating fan is configured to suction air in the cavity into the fan volute, and the air is discharged through the exhaust-air duct.

At least in some embodiments, the exhaust-air duct comprises: an air outlet, facing away from the housing; and an air-outlet cover plate, rotatably connected to the air outlet and configured to cover the air outlet.

At least in some embodiments, the electric motor comprises an output shaft, the output shaft extends out from the housing, the housing comprises a first side and a second side opposite to each other in a direction perpendicular to the output shaft, the air-output assembly and the inversion device are disposed on the first side. The air-cooling heat dissipating mechanism further comprises: an air-input assembly, the air-input assembly comprises an air inlet disposed on the second side of the housing, the air inlet is configured as being communicated with the cavity, such that the air entering the cavity from the air inlet is discharged from the air-output assembly after passing through the electric motor.

At least in some embodiments, the air-input assembly comprises: a groove, disposed at the second side of the housing, wherein the air inlet is disposed in the groove; and a protection mesh, covering the air inlet. A plane where the protection mesh is located is not coplanar with an outer surface of the second side of the housing, and the plane where the protection mesh is closer to the electric motor than the outer surface of the second side of the housing.

At least in some embodiments, the driving heat dissipating device comprises: a liquid-cooling heat dissipating mechanism, the liquid-cooling heat dissipating mechanism comprises: a first cooling assembly, disposed in the cavity defined by the housing, the cavity is configured to accommodate the electric motor; a first fan assembly, disposed on the housing; and a first cooling liquid storage assembly, disposed between the first fan assembly and the housing, the first cooling liquid storage assembly is communicated with the first cooling assembly and configured to supply cooling liquid to the first cooling assembly, and the first fan assembly is configured to perform the heat dissipation on the cooling liquid in the first cooling liquid storage assembly. The first cooling liquid storage assembly, the first fan assembly and the inversion device all are disposed on the same side of the housing.

At least in some embodiments, the inversion heat dissipating device and the driving heat dissipating device share the first cooling liquid storage assembly and the first fan assembly; and the inversion heat dissipating device comprises an inversion cooling plate disposed at one side of the inversion device away from the housing, the shared first fan assembly is disposed at one side of the inversion cooling plate away from the housing, and the shared first cooling liquid storage assembly is disposed between the shared first fan assembly and the inversion cooling plate.

At least in some embodiments, the electric motor comprises an output shaft, the output shaft extends out from the housing, and the housing comprises a first side and a second side opposite to each other in a direction perpendicular to the output shaft; and the shared first cooling liquid storage assembly, the shared first fan assembly, the inversion device and the inversion cooling plate all are disposed on the first side of the housing, and the inversion device covers partial or whole outer surface of the first side of the housing.

At least in some embodiments, the inversion heat dissipating device comprises: an inversion cooling passage, disposed in the inversion cooling plate and comprises an inversion cooling passage inlet and an inversion cooling passage outlet, wherein the first cooling assembly comprises: a first cooling passage, at least one portion of the first cooling passage is disposed in the electric motor, and the first cooling passage comprises a first cooling passage inlet and a first cooling passage outlet, wherein the first cooling liquid storage assembly comprises: a cooling liquid storage chamber, and the cooling liquid storage chamber comprises: an output end, configured to output the cooling liquid to the inversion cooling passage and the first cooling passage; and an input end, configured to receive the cooling liquid flowing back from the inversion cooling passage and the first cooling passage, wherein the inversion cooling passage inlet and the first cooling passage inlet are connected with the output end respectively, and the inversion cooling passage outlet and the first cooling passage outlet are connected with the input end respectively.

At least in some embodiments, the inversion heat dissipating device comprises: an inversion cooling passage, disposed in the inversion cooling plate and comprises an inversion cooling passage inlet and an inversion cooling passage outlet; wherein the first cooling assembly comprises: a first cooling passage, at least one portion of the first cooling passage is disposed in the electric motor, and the first cooling passage comprises a first cooling passage inlet and a first cooling passage outlet, wherein the first cooling liquid storage assembly comprises a cooling liquid storage chamber, and the cooling liquid storage chamber comprises: an output end, configured to output the cooling liquid to the inversion cooling passage and the first cooling passage; and an input end, configured to receive the cooling liquid flowing back from the inversion cooling passage and the first cooling passage, wherein the inversion cooling passage inlet is connected with the output end, the inversion cooling passage outlet is connected with the first cooling passage inlet, and the first cooling passage outlet is connected with the input end.

At least in some embodiments, the driving heat dissipating device comprises an air-cooling heat dissipating mechanism and a liquid-cooling heat dissipating mechanism; and at least one portion of the air-cooling heat dissipating mechanism, at least one portion of the liquid-cooling heat dissipating mechanism, and the inversion device all are disposed on the same side of the housing.

At least in some embodiments, the housing defines a cavity, the cavity is configured to accommodate the electric motor, wherein the air-cooling heat dissipating mechanism comprises: an air-output assembly communicated with the cavity, wherein the liquid-cooling heat dissipating mechanism comprises: a first cooling assembly, disposed in the cavity defined by the housing; a first fan assembly, disposed on the housing; and a first cooling liquid storage assembly, disposed between the first fan assembly and the housing, the first cooling liquid storage assembly is communicated with the first cooling assembly and configured to supply the cooling liquid to the first cooling assembly, and the first fan assembly is configured to perform the heat dissipation on the cooling liquid in the first cooling liquid storage assembly; wherein the air-output assembly, the first cooling liquid storage assembly, the first fan assembly, and the inversion device all are disposed on the same side of the housing.

At least in some embodiments, wherein the electric motor comprises an output shaft, a stator, and a rotor, and the output shaft extends out from the housing, wherein the first cooling assembly comprises: a first cooling passage, at least one portion of the first cooling passage is disposed in the stator in a direction parallel to the output shaft, and wherein the air-cooling heat dissipating mechanism further comprises: an air-input assembly, the air-input assembly comprises an air inlet disposed on the housing, the air inlet is configured as being communicated with the cavity, such that the air entering the cavity from the air inlet passes through the rotor and is discharged from the air-output assembly.

At least in some embodiments, the inversion heat dissipating device and the driving heat dissipating device share the first cooling liquid storage assembly and the first fan assembly, and the inversion heat dissipating device comprises: an inversion cooling plate disposed at one side of the inversion device away from the housing, the shared first fan assembly is disposed at one side of the inversion cooling plate away from the housing, and the shared first cooling liquid storage assembly is disposed between the shared first fan assembly and the inversion cooling plate.

At least in some embodiments, the inversion heat dissipating device comprises: an inversion cooling passage, disposed in the inversion cooling plate and comprises an inversion cooling passage inlet and an inversion cooling passage outlet, wherein the first cooling assembly comprises: a first cooling passage, at least one portion of the first cooling passage is disposed in the electric motor, and the first cooling passage comprises a first cooling passage inlet and a first cooling passage outlet, wherein the first cooling liquid storage assembly comprises: a cooling liquid storage chamber, the cooling liquid storage chamber comprises: an output end, configured to output the cooling liquid to the inversion cooling passage and the first cooling passage; and an input end, configured to receive the cooling liquid flowing back from the inversion cooling passage and the first cooling passage, wherein the inversion cooling passage inlet and the first cooling passage inlet are connected with the output end respectively, and the inversion cooling passage outlet and the first cooling passage outlet are connected with the input end respectively.

At least in some embodiments, the inversion heat dissipating device comprises: an inversion cooling passage, disposed in the inversion cooling plate and comprises an inversion cooling passage inlet and an inversion cooling passage outlet; wherein the first cooling assembly comprises: a first cooling passage, at least one portion of the first cooling passage is disposed in the electric motor, and the first cooling passage comprises a first cooling passage inlet and a first cooling passage outlet; wherein the first cooling liquid storage assembly comprises: a cooling liquid storage chamber, and the cooling liquid storage chamber comprises: an output end, configured to output the cooling liquid to the inversion cooling passage and the first cooling passage; and an input end, configured to receive the cooling liquid flowing back from the inversion cooling passage and the first cooling passage, wherein the inversion cooling passage inlet is connected with the output end, the inversion cooling passage outlet is connected with the first cooling passage inlet, and the first cooling passage outlet is connected with the input end.

At least in some embodiments, the electric motor comprises: a bottom and a top, wherein the housing comprises: a bottom surface on a same side as the bottom of the electric motor, and a top surface on a same side as the top of the electric motor, and wherein at least one portion of the driving heat dissipating mechanism, the inversion device, and the inversion heat dissipating device all are disposed on the top surface of the housing.

According to the second aspect of the present disclosure, it is provided a wellsite apparatus comprising the variable-speed integrated machine according to claim 1.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

Figure 1:
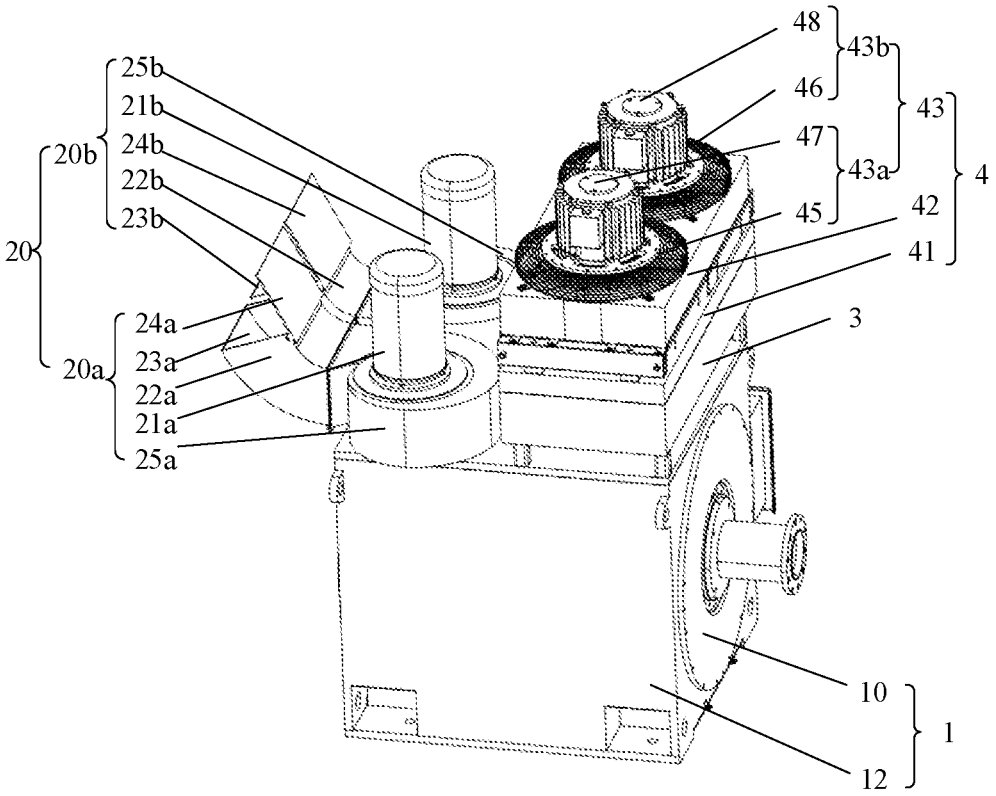
FIG. 1 is a schematically perspective view of a variable-speed integrated machine according to an embodiment of the present disclosure in a first viewing angle.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present disclosure, are not intended to indicate any sequence, amount or importance, but distinguish various components. The terms "comprises," "comprising," "includes," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Compared with diesel-driven fracturing apparatus, the electric-driven fracturing apparatus has the advantages of low noise, no waste-gas pollution, etc. However, the existing electric-driven fracturing apparatus needs a special frequency converter to drive the rotating speed regulation of an electric motor, and the frequency converter includes a rectifying unit (such as a rectifying transformer) and an inverter, which results in that the frequency converter occupies a large space on the electric-driven fracturing apparatus, has a large weight and is inconvenient to transport or move. Moreover, there are a lot of connecting cables between the electric motor and the frequency converter, resulting in troublesome operation.

Accordingly, there is provided a variable-speed integrated machine, that is, the electric motor and the inverter are integrated as a whole. The rectifying unit is not disposed on the variable-speed integrated machine, and is separated from the electric motor and the inverter, so that the speed regulation and driving can be realized by the variable-speed integrated machine. It not only effectively reduces the space occupied by the electric motor and the frequency converter on the electric-driven fracturing apparatus, but also reduces the weight of the electric-driven fracturing apparatus, and thus the transportation is more convenient. Furthermore, more space is saved for installing other apparatus on the fracturing apparatus.

In the working process of the variable-speed integrated machine, due to the high power of the electric motor and inverter, a great amount of heat may be generated. Therefore, a heat dissipating device is needed to perform the heat dissipation on the variable-speed integrated machine so as to guarantee the consecutive work of the electric motor and the inverter within a normal temperature range.

At least one embodiment of the present disclosure provides a variable-speed integrated machine, which includes a driving device, including an electric motor and a housing configured for accommodating the electric motor; an inversion device disposed on the housing and electrically connected with the electric motor; an inversion heat dissipating device disposed at one side of the inversion device away from the housing and configured to perform heat dissipation on the inversion device in a liquid-cooling heat dissipating way; and a driving heat dissipating device, at least one portion of the driving heat dissipating device is disposed on the housing and configured to perform heat dissipation on the driving device in at least one selected from the group of a liquid-cooling heat dissipating way and an air-cooling heat dissipating way, wherein the inversion device and at least one portion of the driving heat dissipating device are disposed on the same side of the housing.

In the variable-speed integrated machine provided by at least one embodiment of the present disclosure, the inversion heat dissipating device is used to perform the heat dissipation on the inversion device, and the driving heat dissipating device is used to perform the heat dissipation on the driving device, so that the consecutive work of the driving device and the inversion device at a normal temperature in a wellsite is guaranteed effectively.

In the case that at least one portion of the driving heat dissipating device and the inversion device in the variable-speed integrated machine are disposed on different sides of the housing respectively, the driving heat dissipating device and the inversion device are dispersed on the surface of the housing, which may possibly lead to uncompact structure of the variable-speed integrated machine and increase the overall size of the variable-speed integrated machine. In the case that the variable-speed integrated machine with large overall size is applied to the wellsite apparatus such as the fracturing apparatus or well-cement apparatus, the occupied space on the wellsite apparatus may be large. When other apparatuses are arranged onto the wellsite apparatus subsequently, the installation space is insufficient, thereby bringing about great difficulty to the subsequent work.

In the variable-speed integrated machine provided by at least one embodiment of the present disclosure, at least one portion of the driving heat dissipating device and the inversion device are disposed on the same side of the housing, which saves the space occupied by the driving heat dissipating device and the inversion device on the variable-speed integrated machine, so that the overall size of the variable-speed integrated machine is reduced. When the variable-speed integrated machine with small overall size is applied to the wellsite apparatus, due to the small overall size of the variable-speed integrated machine, the occupied space on the wellsite apparatus is also reduced, thereby providing more space for installing other apparatuses on the wellsite apparatus.

Moreover, for example, during the fracturing operation, a plurality of electric-driven fracturing trucks (also referred to as a group of electric-driven fracturing truck) are generally provided to execute the fracturing operation together. In order to reduce the area occupied by electric-driven fracturing truck set in the wellsite, the plurality of electric-driven fracturing trucks are placed generally side by side, i.e. in parallel and at an interval. In this case, if at least one portion of the driving heat dissipating device and the inversion device in the variable-speed integrated machine on each electric-driven fracturing truck are disposed on different sides of the housing respectively (for example, the inversion device is disposed on the top surface of the housing, and at least one portion of the driving heat dissipating device is disposed on the side surface of the housing), the at least one portion of the driving heat dissipating device disposed on the side surface may have a small distance to the adjacent electric-driven fracturing truck, thereby affecting the heat dissipating effect of the adjacent electric-driven fracturing truck.

In the variable-speed integrated machine provided by at least one embodiment of the present disclosure, at least one portion of the driving heat dissipating device and the inversion device are disposed on the same side of the housing, so that the impact on the heat dissipating effect of the driving device of the electric-driven fracturing truck due to the small distance between the driving heat dissipating device and the adjacent electric-driven fracturing truck can be minimized and even eliminated. In particular, in the case that at least one portion of the driving heat dissipating device and the inversion device both are disposed on the top surface of the housing, since the top space of the electric-driven fracturing truck is occupied, the space of the side surface is not affected, so that even if a transverse distance between two electric-driven fracturing trucks is small, the heat dissipating effect of the two electric-driven fracturing trucks is not affected.

In the embodiments of the present disclosure, the liquid-cooling heat dissipating way refers to using cooling liquid to take away the heat generated by a to-be-cooled apparatus, thereby achieving heat dissipating purpose. The cooling liquid, for example, includes liquid fluid. The liquid fluid includes at least one selected from the group of water, organic liquid, or inorganic liquid.

In the embodiment of the present disclosure, the air-cooling heat dissipating way is also referred to as an air-cooling heat dissipating way, which achieves the heat dissipating purpose by introducing air into the to-be-cooled apparatus. Compared with the liquid-cooling heat dissipating way, the air-cooling heat dissipating way has the advantages of simple structure, small size, light weight, small heat resistance, large heat exchange area and convenience in use and installation.

In the embodiment of the present disclosure, the same side of the housing refers to, for example, a same surface of the housing of the driving device. When the housing of the driving device includes a plurality of surfaces, at least one portion of the driving heat dissipating device and the inversion device are disposed on the same surface of the plurality of surfaces of the housing. In the embodiment of the present disclosure, "a plurality of" refers to two or more.

In the embodiment of the present disclosure, the driving heat dissipating device may perform the heat dissipation on the driving device in at least one selected from the group of the liquid-cooling heat dissipating way and the air-cooling heat dissipating way. That is, the driving heat dissipating device performs the heat dissipation on the driving device only in the liquid-cooling heat dissipating way; or the driving heat dissipating device performs the heat dissipation on the driving device only in the air-cooling heat dissipating way; or the driving heat dissipating device performs the heat dissipation on the driving device simultaneously in the liquid-cooling heat dissipating way and the air-cooling heat dissipating way. In all embodiments of the present disclosure, the inversion heat dissipating device adopts the liquid-cooling heat dissipating way.

The present disclosure is described below through several specific embodiments. In order to keep the following description of the embodiments of the present disclosure simple and clear, the detail description of known functions and known components is omitted. When any component of the embodiments of the present disclosure presents in one of the above drawings, the component is represented with same reference numerals in all drawings.

Figure 2:
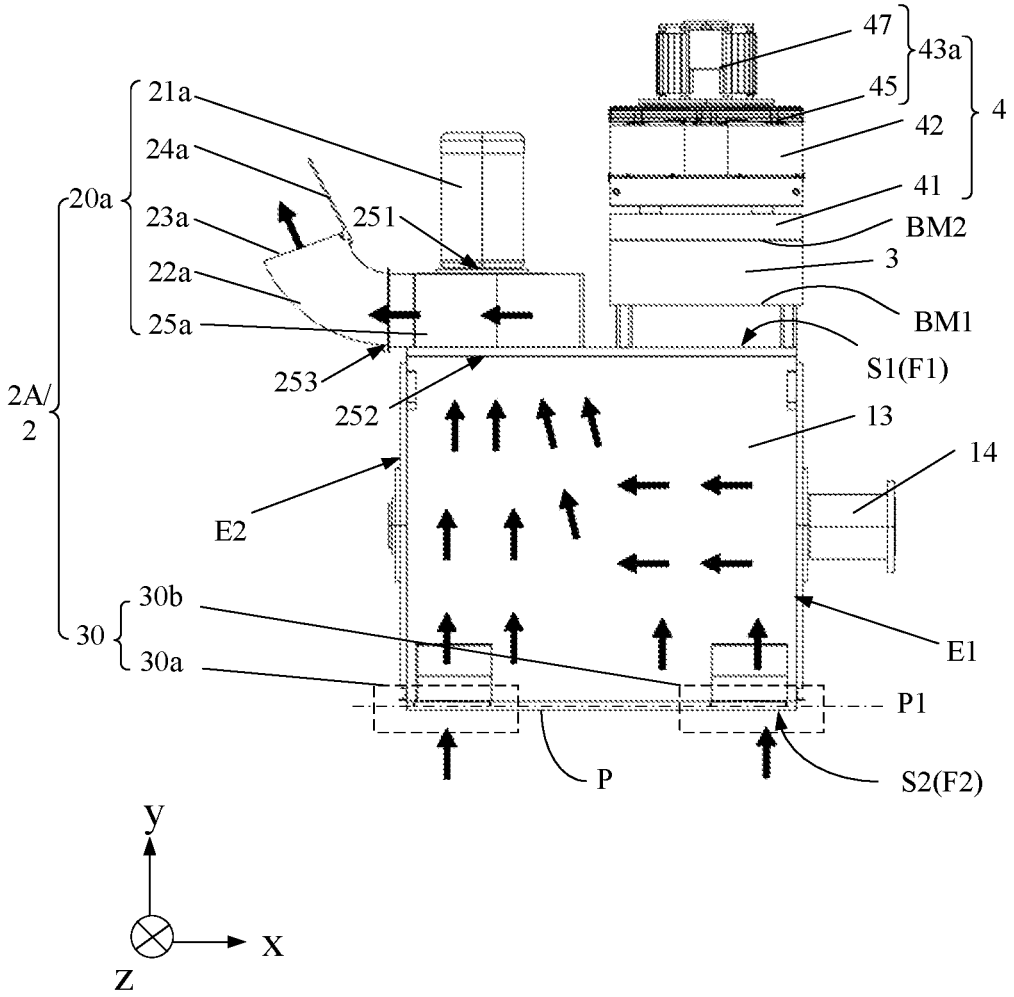
FIG. 2 is a structurally schematic diagram of the variable-speed integrated machine of FIG. 1.

FIG. 1 is a schematically perspective view of a variable-speed integrated machine according to an embodiment of the present disclosure in a first viewing angle. FIG. 2 is a structurally schematic diagram of the variable-speed integrated machine of FIG. 1.

As shown in FIG. 1 to FIG. 2, the variable-speed integrated machine provided by at least one embodiment of the present disclosure includes a driving device 1, a driving heat dissipating device 2, an inversion device 3 and an inversion heat dissipating device 4.

For example, the driving device 1 includes an electric motor 10 and a housing 12 for accommodating the electric motor 10. The electric motor 10 (also referred to as motor) refers to an electromagnetic apparatus which realizes the conversion or transmission of electric energy according to the law of electromagnetic induction. The main function of the electric motor is to generate a driving torque as a power source of the wellsite apparatus. The electric motor may include an AC (alternating current)-power motor a DC (direct current)-power motor. In the embodiment of the present disclosure, the electric motor 10 adopts the AC power motor, that is, the direct current is converted into alternating current.

For example, as shown in FIG. 2, the housing 12 defines a cavity 13 for accommodating the electric motor 10. That is, the electric motor 10 is disposed inside the housing 12. The surface of the housing 12 facing towards the electric motor 10 is an inner surface, and the surface facing away from the electric motor 10 is an outer surface, for example, the outer surface includes a top surface, a bottom surface and a side surface.

As shown in FIG. 1 and FIG. 2, the shape of the housing 12 is basically a cuboid. In at least some embodiments, the shape of the housing 12 may also be columnar, such as a cube, a cylinder and the like. The embodiment of the present disclosure does not limit the shape of the housing 12. When the shape of the housing 12 is cuboid or cube, it is beneficial to fixedly install the inversion device 3 and the inversion heat dissipating device 4 on the housing 12, thereby enhancing the stability of the whole apparatus.

Figure 3:
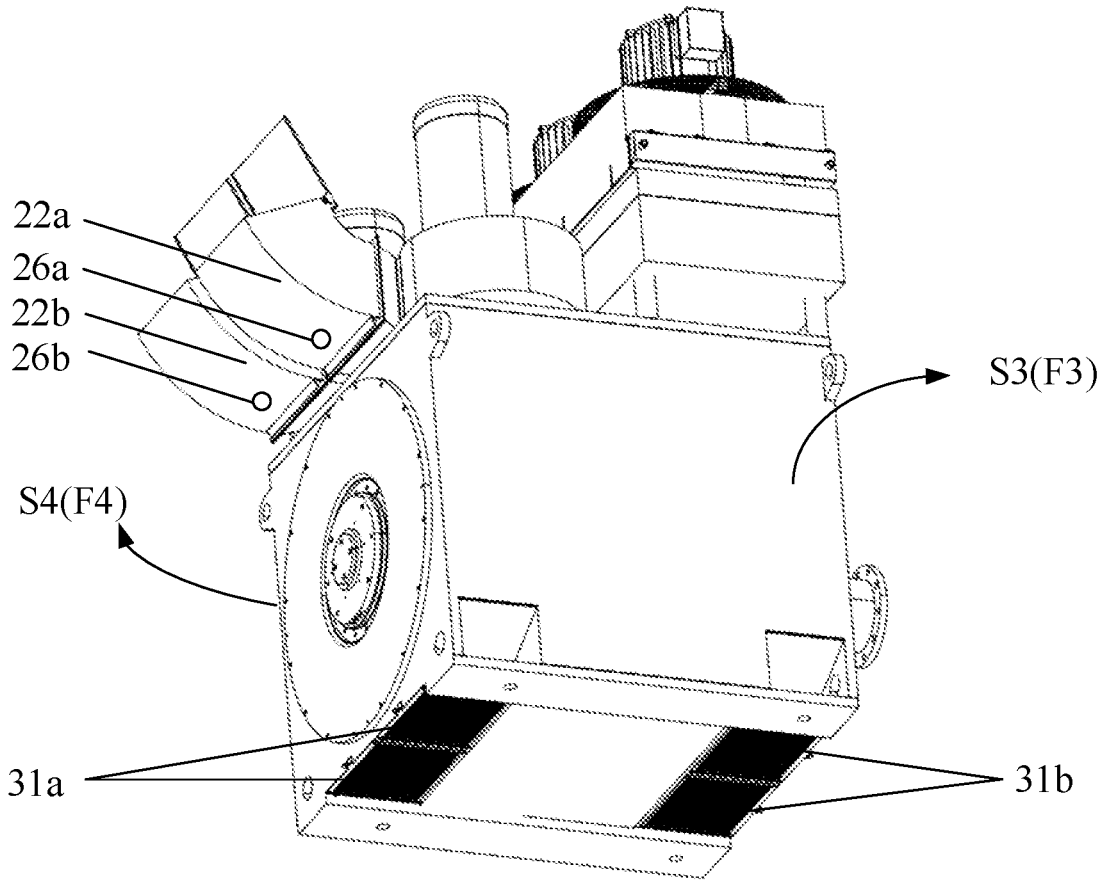
FIG. 3 is a schematically perspective view of the variable-speed integrated machine of FIG. 1 in a second viewing angle.
Figure 4:
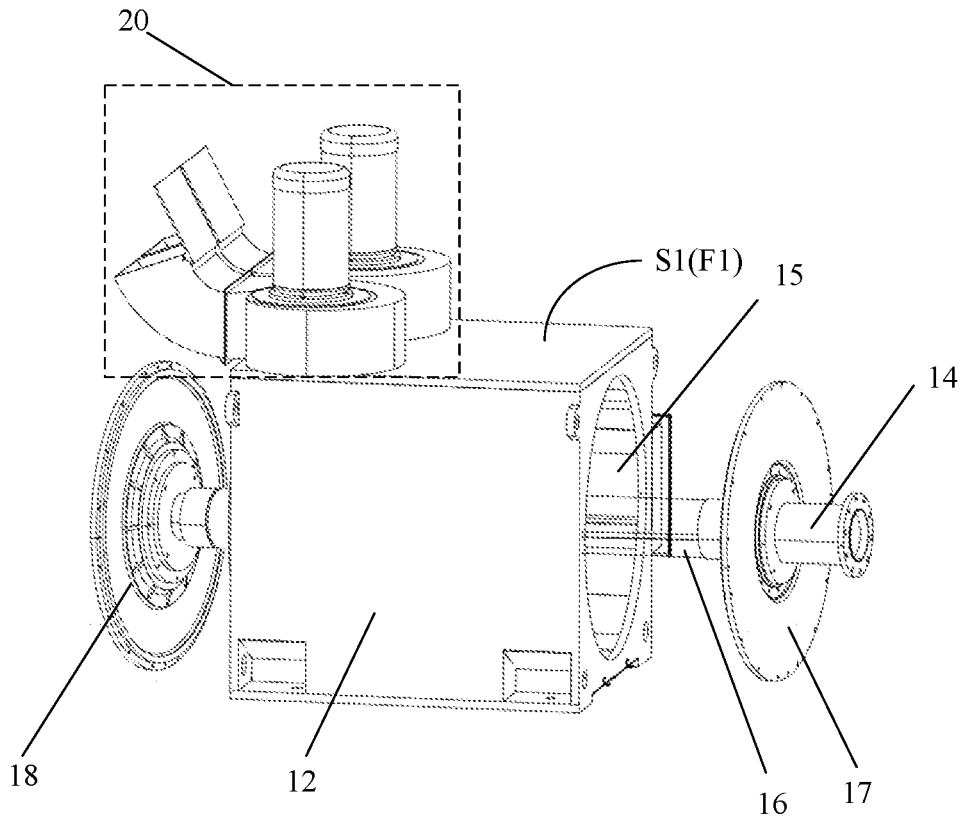
FIG. 4 is a structurally schematic diagram of a driving device and a driving heat dissipating device of FIG. 1.

FIG. 3 is a schematically perspective view of the variable-speed integrated machine of FIG. 1 in a second viewing angle. FIG. 4 is a structurally schematic diagram of a driving device and a driving heat dissipating device of FIG. 1.

As shown in FIG. 1, FIG. 2 and FIG. 4, the electric motor 10 includes an output shaft 14, a stator 15, a rotor 16, an end cap 17 and a bearing cap 18.

For example, as shown in FIG. 4, the stator 15 is a fixed portion in the electric motor 10, which plays a role in generating a magnetic field and is used as a mechanical support of the electric motor. The stator 15, for example, is an outermost cylinder. The inner side of the cylinder is provided with a plurality of windings, which are connected with an external AC power supply. The whole cylinder is connected with a base and is stationary. The stator 15, for example, includes a stator iron core, a stator winding and the base.

For example, the rotor 16 is a rotating portion in the electric motor 10. The rotor 16 is disposed in an inner cavity of the stator 15 and connected with the output shaft 14 of the electric motor 10 and rotates together with the output shaft 14 at the same speed. The rotor 16, for example, includes a rotor iron core and a rotor winding. There is no connection or contact between the stator 15 and the rotor 16. However, in the case that the stator winding is provided with the AC power, the rotor 16 begins to rotate immediately and output the power through the output shaft 14.

For example, as shown in FIG. 1, FIG. 2 and FIG. 4, the output shaft 14 extends outwardly from the end cap 17 of the housing 12 and extends along a first direction (such as the x direction shown in FIG. 2). The housing 12 includes a first side S1 and a second side S2 which are opposite to each other in a second direction (such as the y direction shown in FIG. 2) perpendicular to the x direction. For example, the first side S1 is an upper side shown in FIG. 2, and the second side S2 is a lower side shown in FIG. 2. The housing 12 has a top surface F1 and a bottom surface F2 corresponding to the upper side and lower side respectively.

For example, as shown in FIG. 3, the housing 12 further includes a third side S3 and a fourth side S4 which are opposite to each other in a third direction (such as the z direction shown in FIG. 2). Accordingly, the housing 12 has two side surfaces F3 and F4 corresponding to the third side S3 and the fourth side S4 respectively.

In at least some embodiments, the inversion device 3 may be located on one of the first side S1, the second side S2, the third side S3 and the fourth side S4 of the housing 12. For example, the inversion device 3 is located on one of the top surface F1, the bottom surface F2 and the two side surfaces F3, F4 of the housing 12. As shown in FIG. 1 and FIG. 2, the inversion device 3, for example, is located on the top surface F1 of the housing 12, and the top surface F1 of the housing 12 plays a role in fixing and supporting the inversion device 3.

In the case that the variable-speed integrated machine is applied to the wellsite apparatus such as the electric-driven fracturing truck, the inversion device 3 is located on one of the first side S1, the third side S3 and the fourth side S4 of the housing 12, that is, the inversion device 3 is not located at the second side S2 of the housing 12, because the second side S2 is used as the bottom of the variable-speed integrated machine, which may be in direct contact with the electric-driven fracturing truck when the variable-speed integrated machine is disposed or installed on the electric-driven fracturing truck.

The embodiment of the present disclosure does not limit a connection way between the inversion device 3 and the housing 12, as long as the two may be fixedly installed together. For example, the housing 12 and the inversion device 3 may be fixedly installed by bolts or in a riveting way or in a welding way, etc.

In at least some embodiments, the inversion device 3 is an inverter, and the inverter is electrically connected with the electric motor 10. For example, the inversion device 3 is connected with the electric motor 10 through a power supply wiring and used to supply power to the electric motor 10. Generally, when the frequency converter performs frequency conversion on the AC power supply, the alternating current is first converted into direct current, i.e. "rectifying", and then the direct current is converted into variable-frequency alternating current, i.e. "inversion".

The variable-speed integrated machine of the embodiment of the present disclosure is integrated with the inverter and the electric motor, and does not include any rectifying unit. Therefore, only the inversion device 3 is disposed on the driving device 1, thereby reducing the overall size and weight of the variable-speed integrated machine. The variable-frequency alternating current is outputted from the inversion device 3 into the electric motor 10 to regulate the rotating speed of the electric motor 10.

As shown in FIG. 1 and FIG. 2, the inversion heat dissipating device 4 is disposed at one side of the inversion device 3 away from the housing 12. That is, the inversion device 3 and the inversion heat dissipating device 4 both are disposed on the same side of the housing 12, and the inversion device 3 is located between the housing 12 and the inversion heat dissipating device 4.

In the case that the inversion device 3 and the inversion heat dissipating device 4 are disposed at different sides of the housing 12 respectively, the inversion device 3 and the inversion heat dissipating device 4 are located on different surfaces of the housing 12, which may increase the overall size of the variable-speed integrated machine. Furthermore, in the case that the two are located on different surfaces of the housing 12, because the inversion heat dissipating device 4 adopts the liquid-cooling heat dissipating way to perform the heat dissipation on the inversion device 3, a length of a cooling pipeline for supplying the cooling liquid needs to be longer, which may affect the heat dissipating effect of the inversion heat dissipating device 4 on the inversion device 3.

In the variable-speed integrated machine of at least one embodiment of the present disclosure, the inversion device 3 and the inversion heat dissipating device 4 are located at the same side of the housing 12, which not only makes the structure of the variable-speed integrated machine more compact, but also can ensure the heat dissipating effect of the inversion heat dissipating device 4 on the inversion device 3.

For example, as shown in FIG. 1, the inversion heat dissipating device 4 includes an inversion cooling plate 41 (also referred to as water cooling plate), an inversion cooling liquid storage assembly 42 and an inversion fan assembly 43. The inversion cooling plate 41, the inversion cooling liquid storage assembly 42 and the inversion fan assembly 43 are disposed at the first side S1, for example, on the top surface F1 of the housing 12 sequentially. That is, the inversion cooling plate 41 is disposed at one side of the inversion device 3 away from the housing 12. The inversion cooling liquid storage assembly 42 is disposed on one side of the inversion cooling plate 41 away from the housing 12. The inversion fan assembly 43 is disposed on one side of the inversion cooling liquid storage assembly 42 away from the housing 12.

For example, as shown in FIG. 2, the inversion device 3 is located between the top surface F1 of the housing 12 and the inversion cooling plate 41. The inversion device 3 includes a first surface BM1 close to the housing 12 and a second surface BM2 away from the housing 12. That is, the first surface BM1 and the second surface BM2 are opposite to each other in a direction (such as the y direction shown in the drawing) perpendicular to the output shaft 14, and the first surface BM1 is closer to the housing 12 than the second surface BM2. The inversion cooling plate 41 is located on the second surface BM2 and is in direct contact with the second surface BM2. In this way, when the cooling liquid is introduced into the inversion cooling plate 41, since the inversion cooling plate 41 contacts the second surface BM2 of the inversion device 3, it is beneficial to realize the heat conduction effect, so that the inversion device 3 can be cooled more effectively.

For example, the inversion cooling plate 41 overlaps the inversion device 3 in a direction (such as the y direction shown in the drawing) perpendicular to the output shaft 14, for example, the overlapping may be partial overlapping or complete overlapping. As shown in FIG. 2, the inversion cooling plate 41 completely overlap the inversion device 3 in the y direction, that is, the inversion cooling plate 41 covers the second surface BM2 of the inversion device 3 completely, thus can increase the heat conduction area, thereby realizing better heat dissipating effect.

Figure 5:
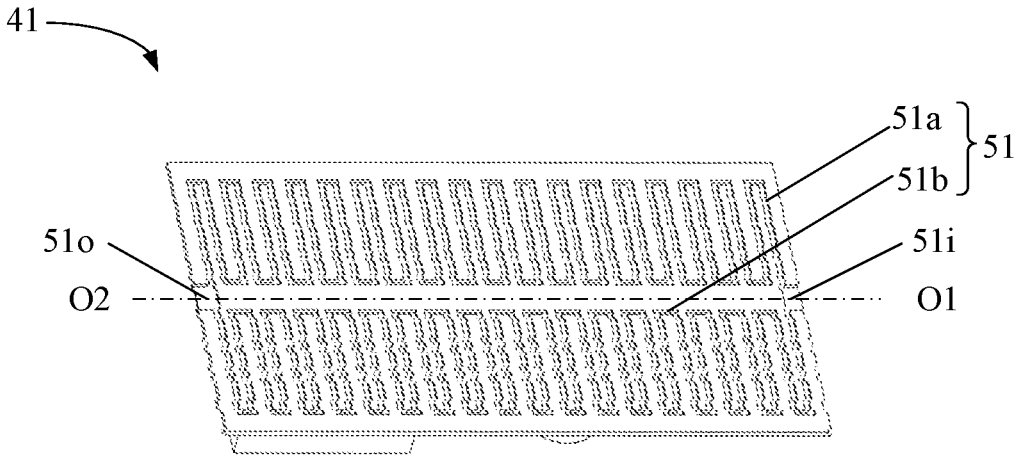
FIG. 5 is a structurally schematic diagram of an inversion cooling plate of FIG. 1.

FIG. 5 is a structurally schematic diagram of the inversion cooling plate of FIG. 1. For example, as shown in FIG. 5, the inversion cooling plate 41, for example, includes an inversion cooling passage 51. The inversion cooling passage 51 includes at least one inversion cooling pipe, an inversion cooling passage inlet 51*i* and an inversion cooling passage outlet 51*o*. The at least one inversion cooling pipe, the inversion cooling passage inlet 51*i* and the inversion cooling passage outlet 510 are disposed at one side of the inversion cooling plate 41 away from the inversion device 3, i.e. the upper side of the inversion cooling plate 41 shown in FIG. 2.

For example, the inversion cooling passage inlet 51*i* is communicated with a first port (such as a right port shown in the drawing) of the at least one inversion cooling pipe. The inversion cooling passage outlet 510 is communicated with a second port (such as a left port shown in the drawing) of the at least one inversion cooling pipe. The second port is different from the first port, and the first port and the second port are opposite to each other in the z direction.

When the inversion cooling liquid flows in the at least one inversion cooling pipe of the inversion cooling plate 41, heat exchange may be performed on the inversion device 3 located below the inversion cooling plate 41, thereby achieving a purpose of cooling the inversion device 3. In order to enhance the cooling effect, the inversion cooling plate 41 is in direct contact with the inversion device 3. In an example, the inversion cooling liquid includes water.

For example, the inversion cooling passage 51 includes an inversion cooling pipe 51*a* and an inversion cooling pipe 51*b*. The inversion cooling pipe 51*a* and the inversion cooling pipe 51*b* share the inversion cooling passage inlet 51*i* and the inversion cooling passage outlet 51*o*. That is, the inversion cooling pipe 51*a* and the inversion cooling pipe 51*b* both are communicated with the inversion cooling passage inlet 51*i*, and the inversion cooling pipe 51*a* and the inversion cooling pipe 51*b* both are communicated with the inversion cooling passage outlet 51*o*. After entering the inversion cooling passage inlet 51*i*, the inversion cooling liquid flows into the inversion cooling pipe 51*a* and the inversion cooling pipe 51*b* respectively to exchange heat with the inversion device 3, and then the inversion cooling liquid after the heat exchange is converged at the inversion cooling passage outlet 510 and flows out.

In the embodiment of the present disclosure, by providing two inversion cooling pipes 51*a* and 51*b*, one shared inversion cooling passage inlet 51*i* and one shared inversion cooling passage outlet 51*o*, not only can the heat exchange area of the water cooling plate be increased and the cooling effect be enhanced, but also the process for manufacturing the inversion cooling plate may be simplified, and the manufacturing cost is reduced.

In at least some embodiments, the inversion cooling pipe 51*a* and the inversion cooling pipe 51*b* may have same or different pipeline layouts, for example, as shown in FIG. 5, The inversion cooling pipe 51*a* and the inversion cooling pipe 51*b* are in mirror-symmetry about a center line O1O2 of the inversion cooling plate 41. Since the inversion cooling pipe 51*a* and the inversion cooling pipe 51*b* have the same pipeline layout, the manufacturing process of the inversion cooling plate is further simplified.

FIG. 5 only schematically illustrates an S-shaped pipeline direction of the inversion cooling pipe 51*a* and the inversion cooling pipe 51*b*. In other embodiments of the present disclosure, the inversion cooling pipe 51*a* and the inversion cooling pipe 51*b* may also have other pipeline layouts, such as a sawtooth shape, a straight-line shape, etc., which is not limited by the embodiment of the present disclosure.

Figure 6:
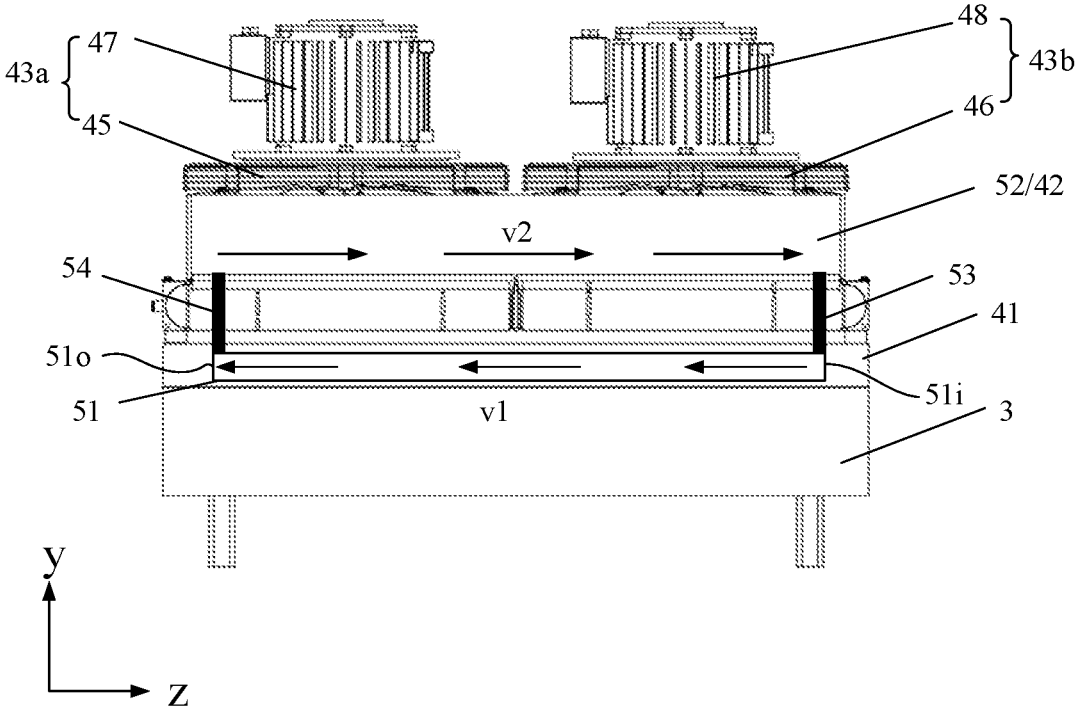
FIG. 6 is a structurally schematic diagram of an inversion device and the inversion heat dissipating device of FIG. 2.

FIG. 6 is a structurally schematic diagram of the inversion device and the inversion heat dissipating device of FIG. 2. For example, as shown in FIG. 6, the inversion cooling liquid storage assembly 42 is disposed at one side of the inversion cooling plate 41 away from the inversion device 3 and includes an inversion cooling liquid storage chamber 52 communicated with the inversion cooling plate 41, which is used to store the inversion cooling liquid and supply the inversion cooling liquid to the inversion cooling plate 41. The inversion cooling liquid here refers to the cooling liquid for cooling the inversion device 3.

For example, a first end (such as the right end shown in the drawing) of the inversion cooling liquid storage chamber 52 is connected with the inversion cooling passage inlet 51*i* through a first connecting pipe 53. A second end (such as the left end shown in the drawing) of the inversion cooling liquid storage chamber 52 is connected with the inversion cooling passage outlet 510 through a second connecting pipe 54. The second end is different from the first end, and the first end and the second end are opposite to each other in the z direction. In the embodiments of the present disclosure, the inversion cooling liquid flows into the inversion cooling plate 41 from the inversion cooling liquid storage chamber 52 through the first connecting pipe 53 and flows back to the inversion cooling liquid storage chamber 52 from the inversion cooling plate 41 through the second connecting pipe 54, thereby achieving a purpose of cyclic use.

For example, the inversion fan assembly 43 is disposed at one side of the inversion cooling liquid storage assembly 42 away from the inversion cooling plate 41 and performs the heat dissipation on the inversion cooling liquid in the inversion cooling liquid storage chamber 52. The total number of the inversion fan assemblies 43 may be one or more. The specific total number of the inversion fan assemblies 43 may be determined by the ordinary skilled in the art according to an area of the inversion cooling liquid storage assembly 42, which is not limited by the embodiment of the present disclosure.

For example, the inversion fan assembly 43 includes a first inversion fan assembly 43*a* and a second inversion fan assembly 43*b*. The first inversion fan assembly 43*a* and the second inversion fan assembly 43*b* are disposed side by side on the inversion cooling liquid storage chamber 52 along the z direction.

For example, the first inversion fan assembly 43*a* includes a heat dissipating fan 45 and a heat dissipating electric motor 47. The heat dissipating electric motor 47 is disposed on the inversion cooling liquid storage assembly 42, and the heat dissipating fan 45 is located between the heat dissipating electric motor 47 and the inversion cooling liquid storage assembly 42. When the heat dissipating electric motor 47 works, an impeller of the heat dissipating fan 45 is driven to rotate, and the wind generated by the rotation of the impeller is used to cool the inversion cooling liquid in the inversion cooling liquid storage assembly 42 (such as the inversion cooling liquid storage chamber 52).

For example, the second inversion fan assembly 43*b* includes a heat dissipating fan 46 and a heat dissipating electric motor 48. The heat dissipating electric motor 48 is disposed on the inversion cooling liquid storage assembly 42, and the heat dissipating fan 46 is located between the heat dissipating electric motor 48 and the inversion cooling liquid storage assembly 42. When the heat dissipating electric motor 48 works, an impeller of the heat dissipating fan 46 is driven to rotate, and the wind generated by the rotation of the impeller is used to cool the inversion cooling liquid in the inversion cooling liquid storage assembly 42 (such as the inversion cooling liquid storage chamber 52).

Compared with the case where the inversion cooling liquid storage chamber 52 is provided with only one inversion fan assembly, the first inversion fan assembly 43*a* and the second inversion fan assembly 43*b* may be used simultaneously to cool the inversion cooling liquid in the inversion cooling liquid storage chamber 52, thereby enhancing the cooling effect.

The working principle of the inversion heat dissipating device 4 is described below. As shown in FIG. 6, when the inversion heat dissipating device 4 works, the inversion cooling liquid flows into the inversion cooling passage 51 from the inversion cooling liquid storage chamber 52 through the first connecting pipe 53 and the inversion cooling passage inlet 51*i*, and then flows in the inversion cooling passage 51 along a first moving direction v1. During the flowing process, the inversion cooling liquid takes away the heat generated by a heating component in the inversion device 3 in heat exchange way to cool the heating component. When the inversion cooling liquid performs heat exchange on the heating component, the inversion cooling liquid with rising temperature flows back into the inversion cooling liquid storage chamber 52 through the inversion cooling passage outlet 510 and the second connecting pipe 54. Then, the inversion cooling liquid flowing back into the inversion cooling liquid storage chamber 52 flows along a second moving direction v2. At the same time, the first inversion fan assembly 43*a* and the second inversion fan assembly 43*b* cool the inversion cooling liquid. In this way, the cooled inversion cooling liquid flows back to the inversion cooling plate 41 again to continue to cool the inversion device 3. It should be noted that in order to avoid the current leakage, the inversion cooling liquid of the embodiment of the present disclosure is isolated electrically from an electrical portion in the inversion device 3.

In the inversion heat dissipating device 4 of the embodiment of the present disclosure, by providing the inversion cooling plate 41, the inversion cooling liquid storage assembly 42 and the inversion fan assembly 43, not only can the heat dissipating effect for the inversion device 3 be improved, but also the overall size of the variable-speed integrated machine is reduced. Furthermore, since the inversion cooling liquid is recyclable, the production cost is reduced, the discharging of waste water is also reduced, and the environmental pollution is avoided.

As shown in FIG. 1 to FIG. 4, for example, the driving heat dissipating device 2 performs the heat dissipation on the driving device 1 only in the air-cooling heat dissipating way. In this case, the driving heat dissipating device 2 only includes an air-cooling heat dissipating mechanism.

In at least some embodiments, the inversion device 3 and at least one portion of the air-cooling heat dissipating mechanism are disposed on the same side of the housing 12. For example, as shown in FIG. 1 and FIG. 2, the air-cooling heat dissipating mechanism 2A includes an air-output assembly 20 communicated with the cavity 13 of the housing 12. For example, the air-output assembly 20, the inversion device 3 and the inversion heat dissipating device 4 are disposed on the same side (such as the first side S1 shown in the drawing) of the housing 12. For example, the air-output assembly 20, the inversion device 3 and the inversion heat dissipating device 4 are disposed on the same top surface F1 of the housing 12, which saves the space occupied by the driving heat dissipating device 2, the inversion device 3 and the inversion heat dissipating device 4 on the variable-speed integrated machine, so that the overall size of the variable-speed integrated machine is reduced. When the variable-speed integrated machine with a small size is applied to the wellsite apparatus, due to the small overall size of the variable-speed integrated machine, the occupied space on the wellsite apparatus is also reduced, thereby providing more space for installing other apparatuses on the wellsite apparatus.

As shown in FIG. 2, for example, the driving device 1 includes a first end E1 and a second end E2 which are opposite to each other in the x direction; for example, the first end E1 is close to the output shaft 14 and is an shaft extension end of the driving device 1. The second end E2 is away from the output shaft 14 and is a non-shaft extension end of the driving device 2. The inversion device 3 and the inversion heat dissipating device 4 are disposed on part of the top surface F1 of the housing 12 close to the first end E1 in a lamination manner, whereas the air-output assembly 20 is disposed on the other part of the top surface F1 of the housing 12 close to the second end E2. The air-output assembly 20 and the inversion device 3 (and the inversion heat dissipating device 4) are disposed at the first end E1 and the second end E2 respectively, so that not only can the space of the top surface of the housing 12 be used fully, but also the mutual interference of the driving heat dissipating device and the inversion heat dissipating device 4 during heat dissipation can be avoided.

In at least some embodiments, the total number of the air-output assemblies 20 may be one or more. When the air-cooling heat dissipating mechanism 2A includes a plurality of air-output assemblies, the plurality of air-output assemblies are used to perform the heat dissipation simultaneously on the driving device 1, so that the heat dissipating effect for the driving device 1 can be enhanced.

For example, as shown in FIG. 1 and FIG. 2, the air-cooling heat dissipating mechanism 2A includes a first air-output assembly 20*a* and a second air-output assembly 20*b*. The first air-output assembly 20*a* and the second air-output assembly 20*b* are disposed side by side on the top surface F1 along the z direction. The first air-output assembly 20*a*, the second air-output assembly 20*b*, the inversion device 3 and the inversion heat dissipating device 4 all are disposed on the same side of the housing 12, for example, on the same top surface F1. The first air-output assembly 20*a*, the second air-output assembly 20*b*, the inversion device 3 and the inversion heat dissipating device 4 are disposed on the same top surface F1 of the housing 12, which further saves the space occupied by the driving heat dissipating device 2, the inversion device 3 and the inversion heat dissipating device 4 on the variable-speed integrated machine, so that the overall size of the variable-speed integrated machine is reduced. Furthermore, the heat dissipating effect of the driving heat dissipating device 2 for the driving device 1 is improved.

In at least some embodiments, the first air-output assembly 20*a* and the second air-output assembly 20*b* may have the same structure or may have different structures. When the first air-output assembly 20*a* and the second air-output assembly 20*b* have the same structure, the layout design difficulty of the air-output assembly on the housing 12 may be reduced, and the manufacturing process may be simplified.

For example, the first air-output assembly 20*a* includes a heat dissipating fan 21*a*, an exhaust-air duct 22*a* and a fan volute 25*a*. The heat dissipating fan 21*a* is disposed on the top surface F1 of the housing 12, and the fan volute 25*a* is located between the heat dissipating fan 21*a* and the top surface F1. As shown in FIG. 2, a first side 251 (such as an upper side shown in the drawing) of the fan volute 25*a* is communicated with the heat dissipating fan 21*a*, a second side 252 (such as a lower side shown in the drawing) is communicated with the cavity 13 of the housing 12, and a third side 253 (such as a left side shown in the drawing) is communicated with the exhaust-air duct 22*a*. For example, the first side 251 and the second side 252 are opposite to each other in the y direction, and the third side 253 is located between the first side 251 and the second side 252 and located at one side of the fan volute 25*a* away from the inversion device 3. The fan volute 25*a* is communicated respectively with the heat dissipating fan 21*a*, the exhaust-air duct 22*a* and the cavity 13, which is beneficial to pumping air in the cavity 13 into the exhaust-air duct 22*a* for discharge when the heat dissipating fan 21*a* works.

For example, as shown in FIG. 2, the exhaust-air duct 22*a* includes an air outlet 23*a*. For example, the air outlet 23*a* faces a direction away from the housing 12, such as faces the top of the variable-speed integrated machine. The air outlet 23*a* is disposed in the direction away from the housing 12, so that the air with high temperature is easily discharged from the exhaust-air duct 22*a*. Moreover, when the air is discharged towards the top of the variable-speed integrated machine through the air outlet 23*a*, the interference or impact of the output air on the inversion device 3 or the inversion heat dissipating device 4 is avoided, and the heat dissipating effect of the inversion heat dissipating device 4 on the inversion device 3 is further ensured.

In the practical wellsite, there may be windy or rainy weather, if there is no shelter on the air outlet 23*a*, sand or rain may fall into the exhaust-air duct 22*a*. Especially when encountering extreme weather such as sandstorm, the exhaust-air duct 22*a* may be blocked by a large amount of sand falling into the exhaust-air duct.

For example, the air outlet 23*a* is provided with an air-outlet cover plate 24*a*, and the air-outlet cover plate 24*a*, for example, is rotatably connected to the air outlet 23*a*, so that the air-outlet cover plate 24*a* covers the air outlet 23*a*. In this way, when it is necessary to cover the air outlet 23*a*, the air-outlet cover plate 24*a* covers the air outlet 23*a* through a simple rotating operation, thereby preventing external sand or rain from falling into the exhaust-air duct 22*a* and from blocking the exhaust-air duct. For example, when the area of the air-outlet cover plate 24*a* is larger than or equal to the area of the air outlet 23*a*, a better sheltering effect is achieved.

The embodiment of the present disclosure does not limit a connection way between the air-outlet cover plate 24*a* and the exhaust-air duct 22*a*, as long as the air-outlet cover plate 24*a* can move relative to the air outlet 23*a*, for example, the two may be hinged or connected by screws or in other ways.

FIG. 2 schematically illustrates only one air-outlet cover plate 24*a*, and in other embodiments of the present disclosure, a plurality of air-outlet cover plates may also be provided on the air outlet 23*a*. For example, the air outlet 23*a* is provided with two opposite air-outlet cover plates. When the two air-outlet cover plates are in a closed state, the air outlet 23*a* is covered; and when the two air-outlet cover plates are in an open state, the air outlet 23*a* is uncovered, and then the air in the exhaust-air duct 22*a* may be discharged from the air outlet 23*a*. Thus, the purpose of sheltering the air outlet 23*a* may also be realized by closing the two air-outlet cover plates. Therefore, the embodiment of the present disclosure does not limit the total number of the air-outlet cover plates 24*a*.

For example, as shown in FIG. 1, the first air-output assembly 20*a* and the second air-output assembly 20*b* have the same structure, and the first air-output assembly 20*a* and the second air-output assembly 20*b* have the same air-output direction.

For example, the second air-output assembly 20*b* includes a heat dissipating fan 21*b*, an exhaust-air duct 22*b* and a fan volute 25*b*. The heat dissipating fan 21*b* is disposed on the top surface F1 of the housing 12, and the fan volute 25*b* is located between the heat dissipating fan 21*b* and the top surface F1. A first side (not shown, which may refer to the first side 251 of the fan volute 25*a* of the first fan assembly) of the fan volute 25*b* is communicated with the heat dissipating fan 21*b*, a second side (not shown, which may refer to the second side 252 of the fan volute 25*a* of the first fan assembly) is communicated with the cavity 13 of the housing 12, and a third side (not shown, which may refer to the first side 253 of the fan volute 25*a* of the first fan assembly) is communicated with the exhaust-air duct 22*b*. For example, the first side and the second side are opposite to each other in the y direction, and the third side is located between the first side and the second side of the fan volute 25*b* and located at one side of the fan volute 25*b* away from the inversion device 3. In the embodiment of the present disclosure, the fan volute 25*b* is communicated respectively with the heat dissipating fan 21*b*, the exhaust-air duct 22*b* and the cavity 13, which is conducive to discharging the air in the cavity 13 from the exhaust-air duct 22*b* for discharge when the heat dissipating fan 21*b* works.

For example, the exhaust-air duct 22*b* includes an air outlet 23*b* and an air-outlet cover plate 24*b*. For example, the air outlet 23*b* has the same orientation as the air outlet 23*a* of the second air-output assembly 20*b* and also faces the direction away from the housing 12, for example, faces the top of the variable-speed integrated machine. The air outlet 23*b* is disposed in the same direction as the air outlet 23*a* of the second air-output assembly 20*b*, so that the interference or impact of the output air on the inversion device 3 or the inversion heat dissipating device 4 is avoided, and the heat dissipating effect of the inversion heat dissipating device 4 on the inversion device 3 is further ensured.

In the variable-speed integrated machine provided by the above embodiment, in the process that the air-cooling heat dissipating mechanism 2A is used to perform the heat dissipation on the driving device 1, the heat dissipating fans 21*a* and 21*b* are started, then the heat dissipating fans 21*a* and 21*b* pump the air in the cavity 13 into the fan volutes 25*a* and 25*b* and discharge the air towards the top of the variable-speed integrated machine through the air outlets 23*a* and 23*b* of the exhaust-air ducts 22*a* and 22*b*, (as shown by the black thick arrow in FIG. 2), thus achieve the purpose of cooling the electric motor 10 through the flow of the air.

In at least some embodiments, the bottom of the exhaust-air duct may be provided with a liquid outlet. For example, as shown in FIG. 3, the bottom of the exhaust-air duct 22*a* close to the housing 13 is provided with a liquid outlet 26*a*, and the bottom of the exhaust-air duct 22*b* close to the housing 13 is provided with a liquid outlet 26*b*. The liquid outlets 26*a* and 26*b* are configured to discharge the liquid (such as rain) flowing into the exhaust-air duct 22*a*. Further, for example, the liquid outlets 26*a* and 26*b* may also be connected with a guide pipe, such as a hose or a hard pipe, etc., which is used to guide the discharged liquid into a collection apparatus such as a water barrel and the like, thereby preventing the direct dripping of the liquid from the liquid outlet from impacting the driving device.

When in stormy weather, it is possible that the rain seeps into the exhaust-air ducts 22*a* and 22*b* and is accumulated at the bottoms of the exhaust-air ducts 22*a* and 22*b*. If the time lasts long, the accumulated water may flow back into a fan turbine, affecting the heat dissipating effect of the fan heat dissipating mechanism on the driving device. In the embodiment of the present disclosure, the bottoms of the exhaust-air ducts 22*a* and 22*b* are provided with the liquid outlets 26*a* and 26*b*, which can discharge the accumulated water in the exhaust-air ducts 22*a* and 22*b*, so that the impact of the accumulated water on the heat dissipating effect can be reduced and even eliminated.

Figure 7:
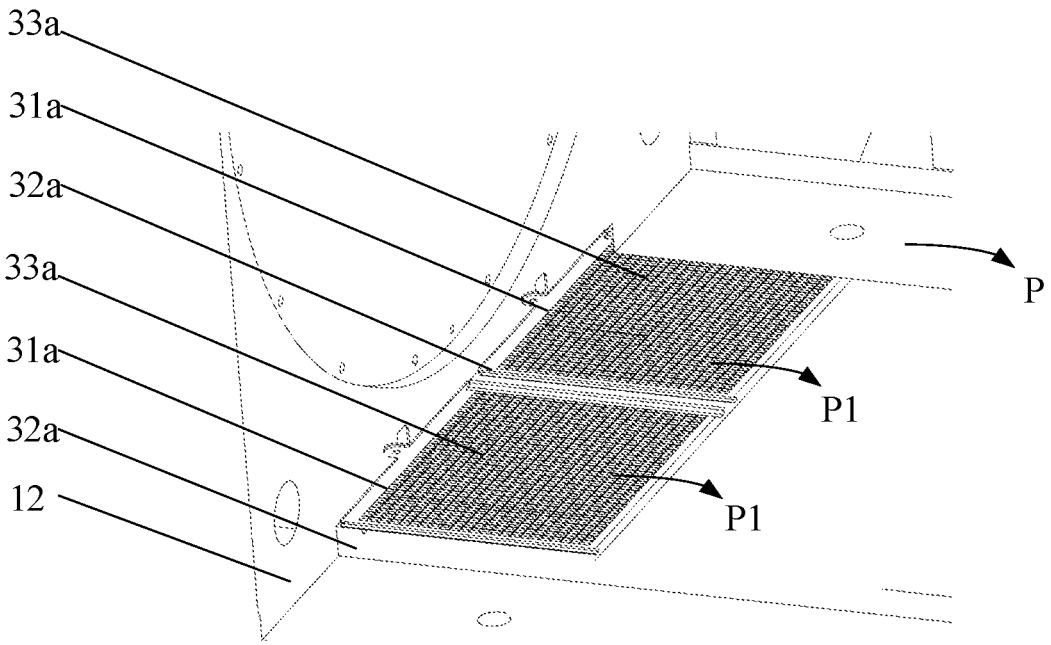
FIG. 7 is an enlarged schematic diagram of a bottom of the variable-speed integrated machine of FIG. 3.

For example, as shown in FIG. 2, FIG. 3 and FIG. 7, the air-cooling heat dissipating mechanism 2A further includes an air-input assembly 30. For example, the air-input assembly 30 is disposed at the other side of the housing 13 than the first side, for example, on the second side S2. In the embodiment of the present disclosure, the total number of the air inlet assemblies 30 may be one or more. When the air-cooling heat dissipating mechanism 2A includes a plurality of air inlet assemblies, the total amount of the air sucked into the driving device 1 may be increased, thereby improving the heat dissipating efficiency.

For example, as shown in FIG. 2, the air-cooling heat dissipating mechanism 2A includes a first air-input assembly 30*a* and a second air-input assembly 30*b*, and the first air-input assembly 30*a* and the second air-input assembly 30*b* are disposed side by side on the second side S2 of the housing 13 along the x direction. For example, the first air-input assembly 30*a* is close to the second end E2 of the housing 13 and away from the first end E1 of the housing 13; and the second air-input assembly 30*b* is close to the first end E1 of the housing 13 and away from the second end E2 of the housing 13. The first air-input assembly 30*a* and the second air-input assembly 30*b* are disposed respectively on the first end E1 and the second end E2 of the housing 13, so that the bottom space of the housing is used fully and reasonably, and better heat dissipating effect is achieved.

For example, as shown in FIG. 3, the first air-input assembly 30*a* includes two air inlets 31*a* disposed on the second side S2 of the housing. Further, the two air inlets 31*a* are disposed side by side on the bottom surface F2 of the housing 12 along the z direction. In the embodiment of the present disclosure, the total number of the air inlets 31*a* may be one or more. When the first air-input assembly 30*a* includes a plurality of air inlets 31*a*, the heat dissipating effect on the driving device 1 can be improved.

For example, as shown in FIG. 3, the second air-input assembly 30*b* includes two air inlets 31*b* disposed on the second side S2 of the housing. Further, the two air inlets 31*b* are disposed side by side on the bottom surface F2 of the housing 12 along the z direction. In the embodiment of the present disclosure, the total number of the air inlets 31*b* may be one or more. When the second air-input assembly 30*b* includes a plurality of air inlets 31, the heat dissipating effect on the driving device 1 can be improved.

Figure 11:
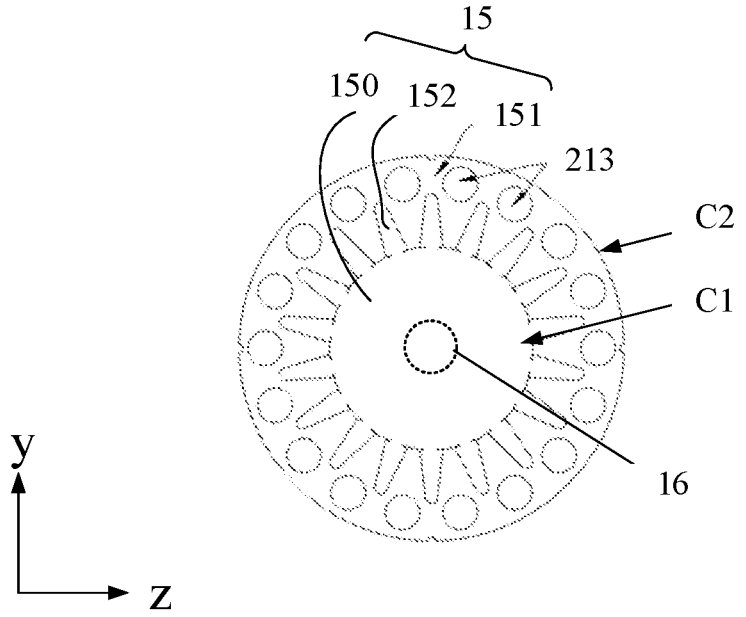
FIG. 11 is a schematically cross-sectional view of a stator in the driving device according to an embodiment of the present disclosure.

In the variable-speed integrated machine provided by the above embodiment, in the process that the air-cooling heat dissipating mechanism 2A is used to perform the heat dissipation on the driving device 1, when the heat dissipating fans 21*a* and 21*b* are started, external air is sucked into the cavity 13 through the two air inlets 31*a* and two air inlets 31*b* on the bottom surface F2 of the housing 12 (as shown by the black thick arrow in FIG. 2) to cool the electric motor 10 disposed in the cavity 13, and then the air is discharged from the exhaust-air ducts 22*a* and 22*b* under the pumping effect of the heat dissipating fans 21*a* and 21*b*. It should be understood that the air sucked into the cavity 13 pass by the inner cavity 150 (as shown in FIG. 11) of the stator 15, thereby realizing the heat dissipating effect on the electric motor 10.

In at least some embodiments, the first air-input assembly 30*a* and the second air-input assembly 30*b* may have the same structure or may have different structures. When the first air-input assembly 30*a* and the second air-input assembly 20*b* have the same structure, the manufacturing process is simplified.

The embodiment of the present disclosure is described by taking the case where the first air-input assembly 30*a* and the second air-input assembly 30*b* have the same structure as an example; and moreover, the embodiment of the present disclosure only describes the first air-input assembly 30*a*, and a specific structure and configuration way of the second air-input assembly 30*b* may refer to the first air-input assembly 30*a* and are not repeated here.

FIG. 7 is an enlarged schematic diagram of a bottom of the variable-speed integrated machine of FIG. 3. As shown in FIG. 7, for example, the first air-input assembly 30*a* further includes two grooves 32*a* arranged on the second side S2 of the housing 12. Each groove 32*a* is recessed inwardly in a direction facing towards the electric motor 10. The two grooves 32*a* are in one-to-one correspondence with the two air inlets 31*a*, that is, each air inlet 31*a* is disposed in one of the two grooves 32*a*.

For example, as shown in FIG. 7, the first air-input assembly 30*a* further includes two protection meshes 33*a*, and the two protection meshes 33*a* are in one-to-one correspondence with the two air inlets 31*a*, that is, each protection mesh 33*a* covers one air inlet 31*a*. If there is no protection mesh on the air inlet 31*a*, foreign matters may be sucked into the cavity. The air inlet is provided with the protection mesh, which can prevent the foreign matters from being sucked into the cavity 13 of the housing 12, thereby avoiding the impact on the heat dissipating effect.

For example, as shown in FIG. 2 and FIG. 7, the plane P1 where each protection mesh 33*a* is located is not coplanar with partial or whole surface P of the housing 12. For example, the plane P1 where the protection mesh 33*a* is located is closer to the electric motor 10 than the outer surface P of the housing 12. That is, the whole bottom surface of the housing 12 is not in a same plane. When the variable-speed integrated machine is applied to the wellsite apparatus such as the electric-driven fracturing truck, the bottom of the driving device 1 needs to be placed on the electric-driven fracturing truck, that is, the bottom surface of the housing 12 may contact the electric-driven fracturing truck. The plane P1 where the protection mesh 33*a* is located is configured as being closer to the electric motor 10 than the outer surface P of the housing 12, which is conducive for the external air to flow into the cavity 13 more fluently from the bottom of the driving device 1 via the air inlet 31*a*, thereby ensuring that more air is sucked into the cavity 13 in the heat dissipating process.

Figure 8:
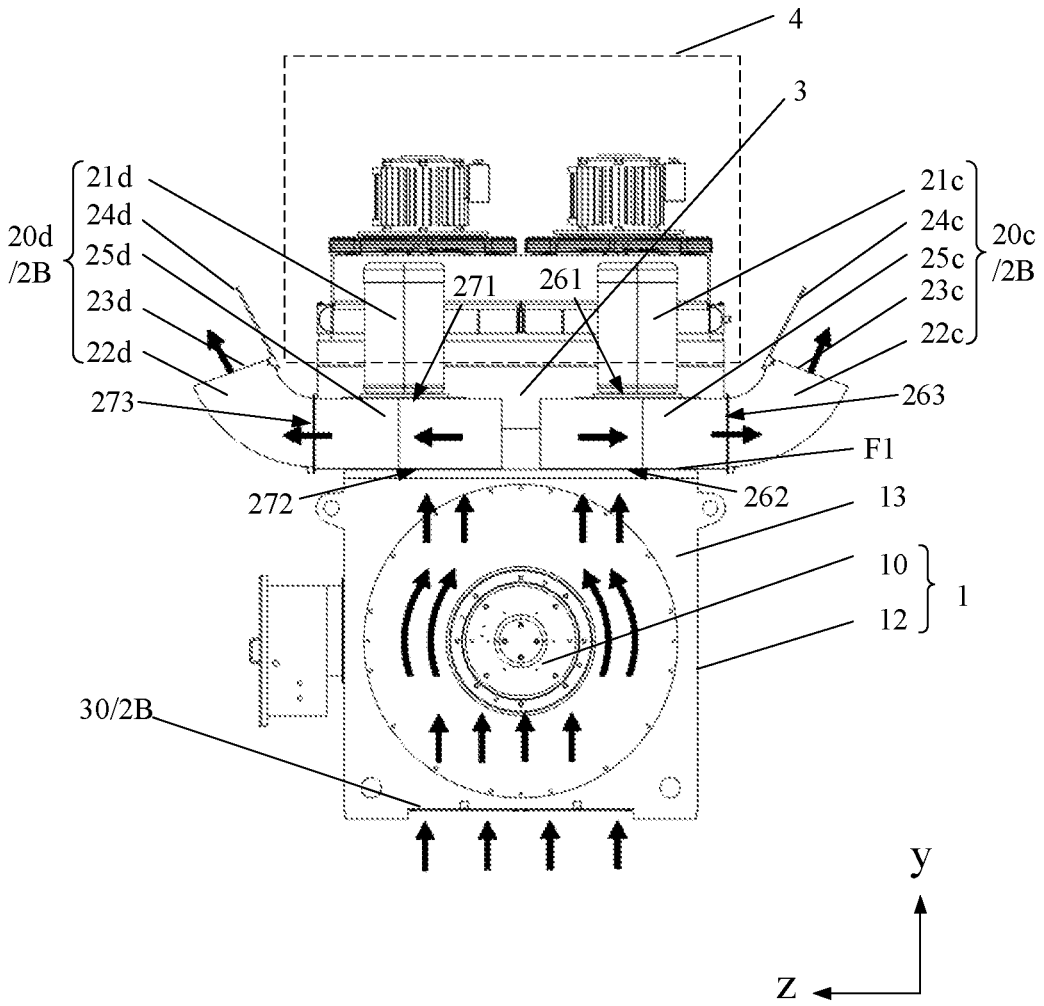
FIG. 8 is a structurally schematic diagram of the variable-speed integrated machine according to another embodiment of the present disclosure.

FIG. 8 is a structurally schematic diagram of the variable-speed integrated machine according to another embodiment of the present disclosure. For example, FIG. 8 is a left view of the variable-speed integrated machine according to another embodiment of the present disclosure. The viewing angle of the left view is the same with that of the left view of the variable-speed integrated machine of FIG. 1.

As shown in FIG. 8, the variable-speed integrated machine provided by at least one embodiment of the present disclosure includes a driving device 1, a driving heat dissipating device 2, an inversion device 3 and an inversion heat dissipating device 4. The driving heat dissipating device 2 adopts an air-cooling heat dissipating mechanism 2B. The air-cooling heat dissipating mechanism 2B includes a third air-output assembly 20*c*, a fourth air-output assembly 20*d* and an air-input assembly 30.

In FIG. 8, the specific structures and arrangement of the driving device 1, the inversion device 3, the inversion heat dissipating device 4 and the air-input assembly 30 may refer to the description of the foregoing embodiments and are not repeated here.

The variable-speed integrated machine in FIG. 8 differs from that in FIG. 1 in that the air-cooling heat dissipating mechanism 2B in FIG. 8 includes the third air-output assembly 20*c* and the fourth air-output assembly 20*d*, and the two have the same structure but different air-output directions.

As shown in FIG. 8, the third air-output assembly 20*c* includes a heat dissipating fan 21*c*, an exhaust-air duct 22*c* and a fan volute 25*c*. The exhaust-air duct 22*c* includes an air outlet 23*c* and an air-outlet cover plate 24*c*. The fourth air-output assembly 20*d* includes a heat dissipating fan 21*d*, an exhaust-air duct 22*d* and a fan volute 25*d*. The exhaust-air duct 22*d* includes an air outlet 23*d* and an air-outlet cover plate 24*d*. The air-output direction of the exhaust-air duct 22*c* of the third air-output assembly 20*c* is different from that of the exhaust-air duct 22*d* of the second air-output assembly 20*d*, that is, the air outlet 23*c* and the air outlet 23*d* have different orientations. For example, as shown by black arrows at the air outlets 23*c* and 23*d* in FIG. 8, the air outlet 23*c* faces towards, for example, the left upper direction, and the air outlet 23*d* faces towards, for example, the right upper direction.

Although the air outlets 23*c* and 23*d* have different orientations, both of them discharge the air towards the top space of the variable-speed integrated machine. When the variable-speed integrated machine is applied to the wellsite apparatus such as the electric-driven fracturing truck, even if the transverse distance between the two electric-driven fracturing trucks is small, the heat dissipating effect of the two electric-driven fracturing trucks is not affected.

As shown in FIG. 8, the heat dissipating fan 21*c* is disposed on the top surface F1 of the housing 12, and the fan volute 25*c* is located between the heat dissipating fan 21*c* and the top surface F1. A first side 261 (such as the upper side shown in the drawing) of the fan volute 25*c* is communicated with the heat dissipating fan 21*c*, a second side 262 (such as the lower side shown in the drawing) is communicated with the cavity 13 of the housing 12, and a third side 263 (such as the right side shown in the drawing)

is communicated with the exhaust-air duct 22*c*. For example, the first side 261 and the second side 262 are opposite to each other in the y direction, and the third side 263 is located between the first side 261 and the second side 262 and located at one side of the fan volute 25*c* away from the fan volute 25*d*. In the embodiment of the present disclosure, the fan volute 25*c* is communicated respectively with the heat dissipating fan 21*c*, the exhaust-air duct 22*c* and the cavity 13, which is conducive to discharging the air in the cavity 13 from the exhaust-air duct 22*c* for discharge when the heat dissipating fan 21*c* works.

As shown in FIG. 8, the heat dissipating fan 21*d* is disposed on the top surface F1 of the housing 12, and the fan volute 25*d* is located between the heat dissipating fan 21*d* and the top surface F1. A first side 271 (such as the upper side shown in the drawing) of the fan volute 25*d* is communicated with the heat dissipating fan 21*d*, a second side 272 (such as the lower side shown in the drawing) is communicated with the cavity 13 of the housing 12, and a third side 273 (such as the left side shown in the drawing) is communicated with the exhaust-air duct 22*d*. For example, the first side 271 and the second side 272 are opposite to each other in the y direction, the third side 273 is located between the first side 271 and the second side 272 and located at one side of the fan volute 25*d* away from the fan volute 25*c*. In the embodiment of the present disclosure, the fan volute 25*d* is communicated respectively with the heat dissipating fan 21*d*, the exhaust-air duct 22*d* and the cavity 13, which is conducive to discharging the air in the cavity 13 from the exhaust-air duct 22*d* for discharge when the heat dissipating fan 21*d* works.

In the variable-speed integrated machine provided by the above embodiment, in the process that the air-cooling heat dissipating mechanism 2B shown in FIG. 8 is used to perform the heat dissipation on the driving device, the heat dissipating fans 21*c* and 21*d* are started, and the external air is sucked into the cavity 13 through the air-input assembly 30 disposed on the bottom of the driving device 1 to cool the electric motor 10 disposed in the cavity 13. Then, under the pumping effect of the heat dissipating fans 21*a* and 21*b*, the air is discharged from the air outlet 23*c* of the exhaust-air duct 22*c* and the air outlet 23*d* of the exhaust-air duct 22*d*, thereby achieving the cooling effect on the electric motor 10.

Similar to FIG. 1, the third air-output assembly 20*c*, the fourth air-output assembly 20*d*, the inversion device and the inversion heat dissipating device in FIG. 8 all are disposed on the same side of the housing 12, for example, on the same top surface F1. The third air-output assembly 20*c*, the fourth air-output assembly 20*d*, the inversion device and the inversion heat dissipating device are disposed on the same side of the housing 12, which further saves the space occupied by the driving heat dissipating device, the inversion device and the inversion heat dissipating device on the variable-speed integrated machine, so that the overall size of the variable-speed integrated machine is reduced.

Figure 9:
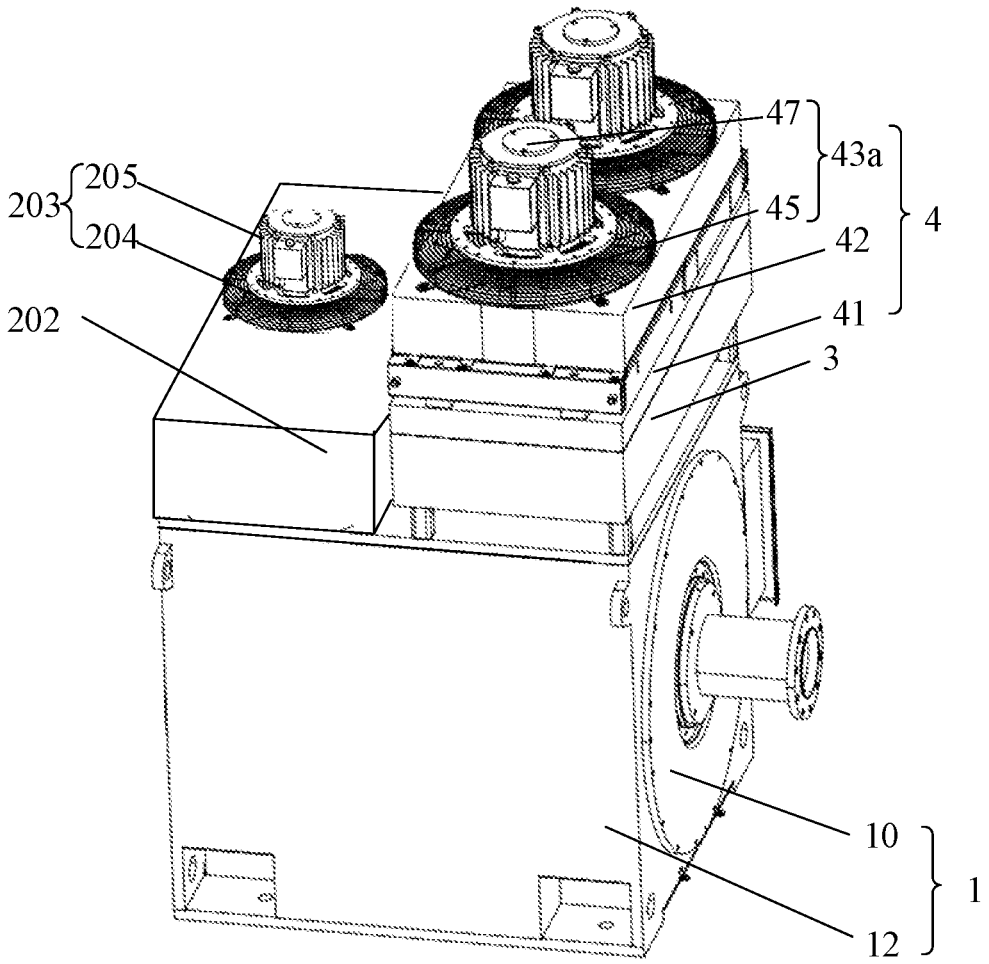
FIG. 9 is a schematically perspective view of the variable-speed integrated machine according to another embodiment of the present disclosure.
Figure 10:
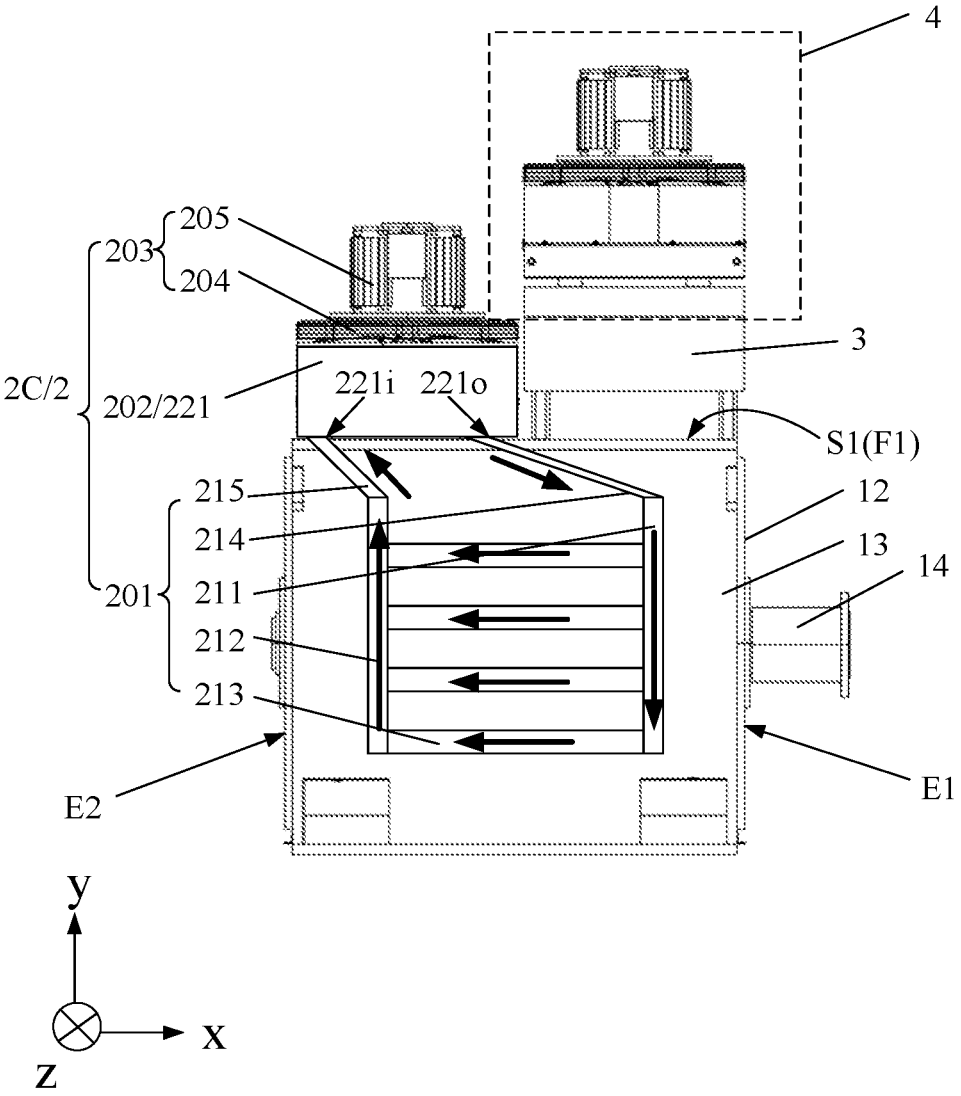
FIG. 10 is a structurally schematic diagram of the variable-speed integrated machine of FIG. 9.

FIG. 9 is a schematically perspective view of the variable-speed integrated machine according to another embodiment of the present disclosure. FIG. 10 is a structurally schematic diagram of the variable-speed integrated machine of FIG. 9.

As shown in FIG. 9 and FIG. 10, the variable-speed integrated machine provided by at least one embodiment of the present disclosure includes a driving device 1, a driving heat dissipating device 2, an inversion device 3 and an inversion heat dissipating device 4.

In FIG. 9, the specific structures and arrangement of the driving device 1, the inversion device 3, and the inversion heat dissipating device 4 may refer to the description of the foregoing embodiments and are not repeated here.

The variable-speed integrated machine in FIG. 9 differs from that in FIG. 1 in that the driving heat dissipating device 2 in FIG. 9 adopts the liquid-cooling heat dissipating way to perform the heat dissipation on the driving device 1. In this case, the driving heat dissipating device 2 only includes a liquid-cooling heat dissipating mechanism 2C. In the variable-speed integrated machine of FIG. 9, the inversion heat dissipating device 4 and the driving heat dissipating device 2 both adopt the liquid-cooling heat dissipating way.

In at least some embodiments, the inversion device 3 and at least one portion of the liquid-cooling heat dissipating mechanism 2C are disposed on the same side of the housing 12 of the driving device 1. For example, as shown in FIG. 9 and FIG. 10, the liquid-cooling heat dissipating mechanism 2C includes a first cooling assembly, a first cooling liquid storage assembly 202 and a first fan assembly 203. The first cooling liquid storage assembly 202, the first fan assembly 203, the inversion device 3 and the inversion heat dissipating device 4 are disposed on the same side (such as the first side S1 of the housing 12 shown in the drawing) of the housing 12, for example, on the same top surface F1. The first cooling liquid storage assembly 202, the first fan assembly 203, the inversion device 3 and the inversion heat dissipating device 4 are disposed on the same side of the housing 12, which saves the space occupied by the driving heat dissipating device 2, the inversion device 3 and the inversion heat dissipating device 4 on the variable-speed integrated machine, so that the overall size of the variable-speed integrated machine is reduced.

For example, as shown in FIG. 9, the first cooling liquid storage assembly 202 and the first fan assembly 203 are disposed at the first side S1 of the housing 12 sequentially. That is, the first fan assembly 203 is disposed on one side of the first cooling liquid storage assembly 202 away from the housing 12. The first cooling liquid storage assembly 202 includes an electric motor cooling liquid storage chamber 221 communicated with the first cooling assembly and used to store the cooling liquid and supply the electric motor cooling liquid to the first cooling assembly. Herein, the electric motor cooling liquid refers to the cooling liquid for cooling the driving device 1.

For example, as shown in FIG. 10, the electric motor cooling liquid storage chamber 221 includes an input end 221*i* and an output end 221*o*. The first cooling assembly is disposed in the housing 12 and includes a first cooling passage 201. The first cooling passage 201 includes a first cooling passage inlet and a first cooling passage outlet. The first cooling passage inlet is connected with the output end 221*o* of the electric motor cooling liquid storage chamber 221. The first cooling passage outlet is connected with the input end 221*i*. The first cooling passage 201 is used to convey the electric motor cooling liquid to the electric motor 10.

For example, the first cooling passage 201 includes a first cooling pipe 211, a second cooling pipe 212, a third cooling pipe 213, a first connecting branch pipe 214 and a second connecting branch pipe 215. The first cooling pipe 211, the second cooling pipe 212, the third cooling pipe 213, the first connecting branch pipe 214 and the second connecting branch pipe 215 each is configured to convey the electric motor cooling liquid.

For example, the first cooling pipe 211 is connected with the output end 221*o* of the electric motor cooling liquid storage chamber 221 through the first connecting branch pipe 214; and the second cooling pipe 212 is connected with the input end 221*i* of the electric motor cooling liquid storage chamber 221 through the second connecting branch pipe 215. The third cooling pipe 213 is located between the first cooling pipe 211 and the second cooling pipe 212 and connected with both of the first cooling pipe 211 and the second cooling pipe 212. In this way, the electric motor cooling liquid in the electric motor cooling liquid storage chamber 221 may pass through the first connecting branch pipe 214, the first cooling pipe 211, the third cooling pipe 213, the second cooling pipe 212 and the second connecting branch pipe 215 successively, and then flow back into the electric motor cooling liquid storage chamber 221. During flowing in the first cooling passage 201, the electric motor cooling liquid takes away the heat generated by the electric motor 10 in a heat exchange way, thereby cooling the electric motor 10.

In at least some embodiments, the total number of the third cooling pipes 213 may be one or more, and when a plurality of third cooling pipes 213 are provided, the cooling effect on the electric motor 10 may be improved.

FIG. 11 is a schematically cross-sectional view of a stator in the driving device according to an embodiment of the present disclosure. For example, FIG. 11 is a schematically cross-sectional view of the stator 15 of the electric motor 10 in FIG. 9. In FIG. 9 to FIG. 11, the electric motor includes an output shaft 14, a stator 15 and a rotor 16. The specific structures of the output shaft 14, the stator 15 and the rotor 16 and arrangement thereof in the driving device may refer to the description of the foregoing embodiments and are not repeated here.

For example, the electric motor 10 includes the stator 15; the stator 15 includes a body portion 151 and a stator winding 152; and the stator 15 defines an inner cavity 150. The rotor 16 is disposed in the inner cavity 150 of the stator 15. The body portion 151 is, for example, in a cylindrical shape and includes an inner side C1 close to the rotor 16 and an outer side C2. The inner side C1 and the outer side C2 are opposite to each other in a radial direction of the stator 15. The stator winding 152 is disposed on the inner side C1 of the body portion 151, and a plurality of third cooling pipes 213 are disposed on the outer side C2 of the body portion 151.

For example, the plurality of third cooling pipes 213 are disposed on partial or whole peripheral portion of the outer side C2 of the body portion 151. When the plurality of third cooling pipes 213 are disposed in the whole peripheral portion of the outer side C2 of the body portion 151, the heat exchange area of the electric motor cooling liquid is increased, and the heat dissipating effect is improved.

For example, the plurality of third cooling pipes 213 are disposed on the whole peripheral portion of the body portion 151 at equal or unequal intervals. When the plurality of third cooling pipes 213 are disposed on the whole peripheral portion of the outer side C2 of the body portion 151 at equal intervals, the heat dissipation uniformity is improved, and the overall heat dissipating effect is further ensured.

For example, as shown in FIG. 9 and FIG. 10, the first fan assembly 203 is disposed on the first cooling liquid storage assembly 202 to perform the heat dissipation on the electric motor cooling liquid in the electric motor cooling liquid storage chamber 221. The total number of the first fan assemblies 203 may be one or more. The specific total number of the first fan assemblies 203 may be determined by the ordinary skilled in the art according to an area of the first cooling liquid storage assembly 202, which is not limited by the embodiment of the present disclosure.

For example, the first fan assembly 203 includes a first heat dissipating fan 204 and a first heat dissipating electric motor 205. The first heat dissipating electric motor 205 is disposed at one side of the electric motor cooling liquid storage chamber 221 away from the housing 12, and the first heat dissipating fan 204 is located between the first heat dissipating electric motor 205 and the electric motor cooling liquid storage chamber 221. When the first heat dissipating electric motor 205 works, an impeller of the first heat dissipating fan 204 is driven to rotate, and the wind generated by the rotation of the impeller is used to cool the electric motor cooling liquid in the electric motor cooling liquid storage assembly 202 (such as the electric motor cooling liquid storage chamber 221).

In the variable-speed integrated machine provided by the above embodiment, in the process that the air-cooling heat dissipating mechanism 2C is used to cool the driving device 1, the electric motor cooling liquid flows into the first cooling pipe 211, the third cooling pipe 213 and the second cooling pipe 212 from the electric motor cooling liquid storage chamber 221 through the first connecting branch pipe 214. In the flowing process, the electric motor cooling liquid takes away the heat generated by the electric motor 10 through a heat exchange way, thereby cooling the electric motor 10. After performing heat exchange with the electric motor 10, the electric motor cooling liquid with rising temperature flows back into the electric motor cooling liquid storage chamber 221 through the second connecting branch pipe 215. Since the electric motor cooling liquid is recyclable, not only is the production cost reduced, but also the discharging of waste water is reduced, and the environmental pollution is avoided.

In at least some embodiments, since the driving device 1 adopts the liquid-cooling heat dissipating way, compared with the air-cooling heat dissipating way, it is unnecessary to form any openings on the housing 12 to be communicated with an exhaust pipe. Therefore, the housing 12 is basically in a hermetic state, so that the interior of the housing is isolated from the exterior. When explosion occurs outside the driving device 1, the explosion probability of the electric motor 10 is reduced, thereby realizing the explosion-proof function of the electric motor. Since the inversion device 3 adopts the liquid-cooling heat dissipating way, the inversion device 3 also realizes the explosion-proof function, thereby further improving the overall explosion-proof effect of the variable-speed integrated machine.

Figure 12:
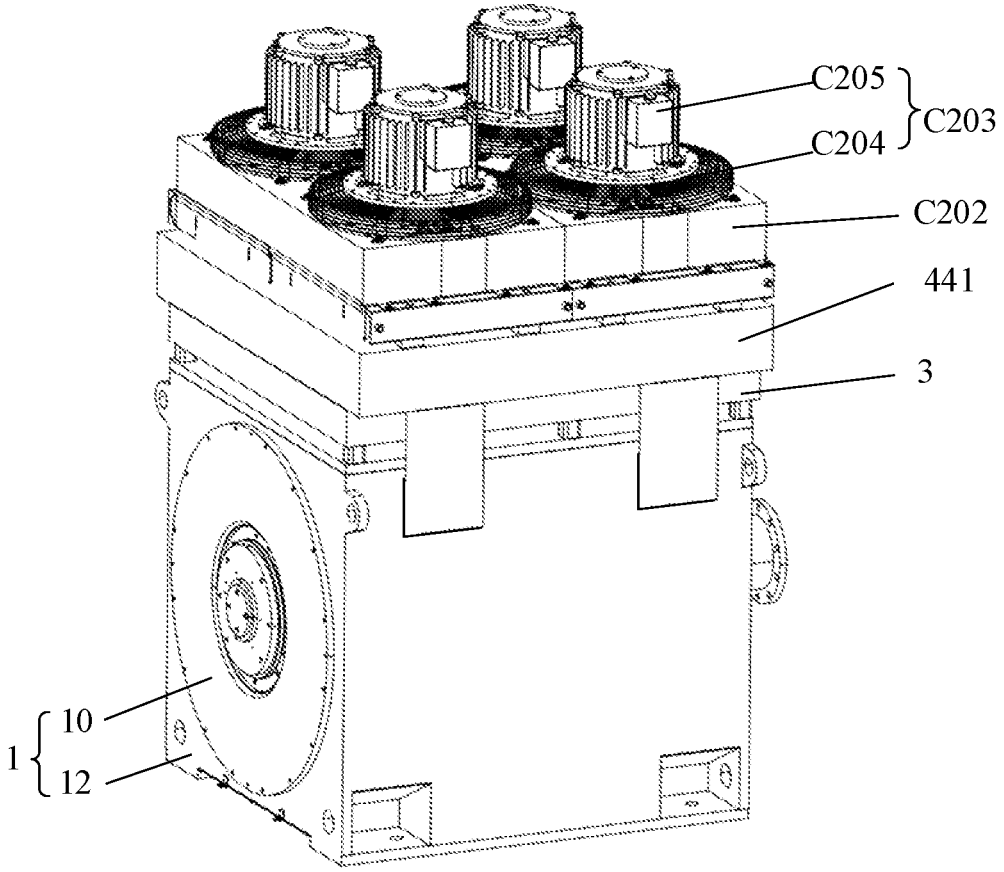
FIG. 12 is a schematically perspective view of the variable-speed integrated machine according to further another embodiment of the present disclosure.
Figure 13:
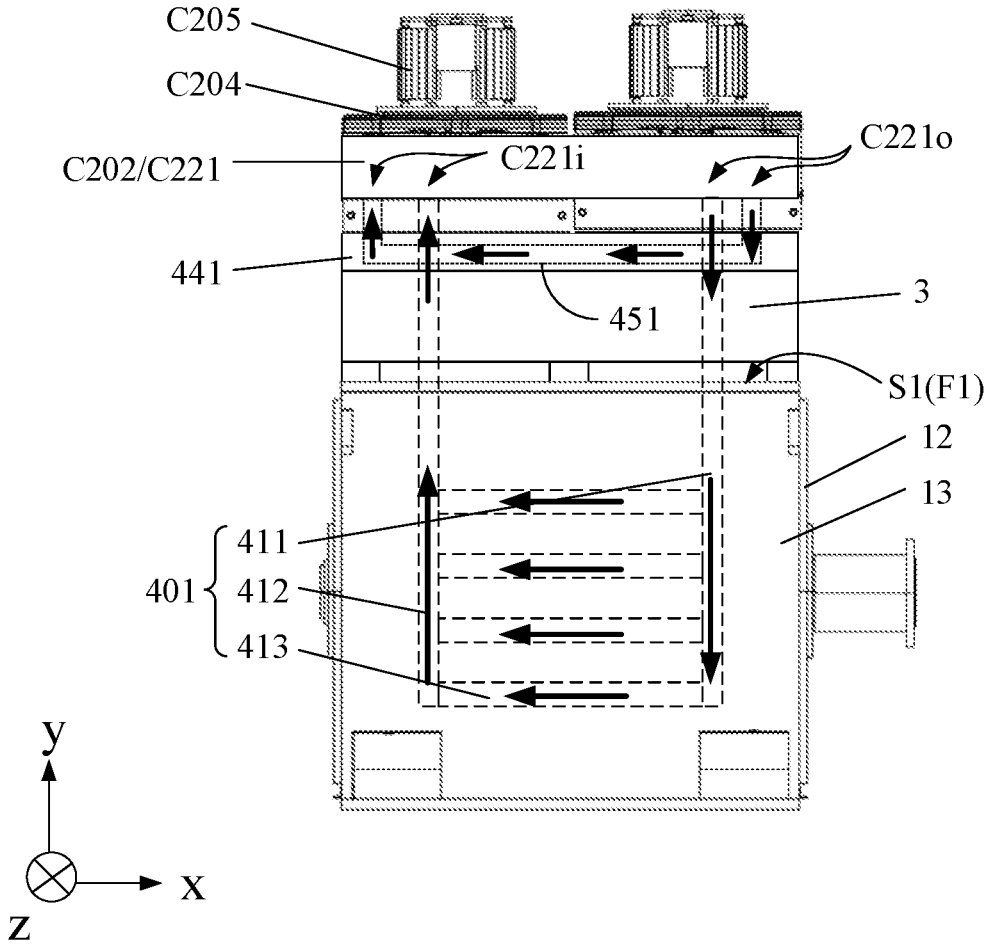
FIG. 13 is a structurally schematic diagram of the variable-speed integrated machine of FIG. 12.

FIG. 12 is a schematically perspective view of the variable-speed integrated machine according to further another embodiment of the present disclosure. FIG. 13 is a structurally schematic diagram of the variable-speed integrated machine of FIG. 12.

As shown in FIG. 12 and FIG. 13, the variable-speed integrated machine provided by at least one embodiment of the present disclosure includes a driving device 1, a driving heat dissipating device, an inversion device 3 and an inversion heat dissipating device. The inversion heat dissipating device and the driving heat dissipating device both adopt the liquid-cooling heat dissipating way.

The variable-speed integrated machine in FIG. 12 differs from that in FIG. 9 in that the inversion heat dissipating device and the driving heat dissipating device in FIG. 12 share the first cooling liquid storage assembly and the first fan assembly.

For example, as shown in FIG. 12 and FIG. 13, the driving device 1 includes an electric motor 10 and a housing 12 for accommodating the electric motor 10. The inversion device 3 is disposed at the first side S1, for example, on the top surface F1 of the housing 12, and the inversion device 3 is electrically connected with the electric motor 10. The specific structures of the electric motor 10 and the housing 12 may refer to the description of the foregoing embodiments and are not repeated here.

For example, the inversion device 3 covers partial top surface F1 or whole top surface F1. When the inversion device 3 covers the whole top surface F1, the heat dissipating area of the inversion heat dissipating device is increased, thereby improving the heat dissipating efficiency. The inversion device 3 covers partial top surface F1, which is conducive to installation of additional apparatuses such as the air-cooling heat dissipating mechanism (such as the embodiment shown in FIG. 22 below) on the housing 12.

For example, the inversion heat dissipating device includes an inversion cooling plate 441 (also referred to as a water cooling plate) disposed at one side of the inversion device 3 away from the housing 10. For example, the inversion cooling plate 441 includes an inversion cooling passage 451. The specific structures of the inversion cooling plate 441 and the inversion cooling passage 451 may refer to the description of the inversion cooling plate 41 and the inversion cooling passage 51 in the foregoing embodiments and are not repeated here.

For example, as shown in FIG. 13, the driving heat dissipating device includes a first cooling passage 401, a shared first cooling liquid storage assembly C202 and a shared first fan assembly C203. At least one portion of the first cooling passage 401 is disposed in the cavity 13 defined by the housing 12. For example, the first cooling passage 401 includes a first cooling pipe 411, a second cooling pipe 412 and third cooling pipes 413, wherein the total number of the third cooling pipes 413 is one or more. For example, a plurality of third cooling pipes 413 are disposed in the stator 15 of the electric motor 10. The specific structure and arrangement of the third cooling pipe 413 may refer to the above relevant description of the third cooling pipe 213 and are not repeated here.

For example, the shared first cooling liquid storage assembly C202 is disposed at one side of the inversion cooling plate 441 away from the housing 12. The shared first cooling liquid storage assembly C202 includes a shared first cooling liquid storage chamber C221 which is used to store the cooling liquid and supply the cooling liquid to the first cooling passage 401 and the inversion cooling plate 441.

For example, the shared first cooling liquid storage chamber C221 includes an input end C221*i* and an output end C221*o*. One end of the first cooling passage 401 is communicated with the output end C221*o* of the shared first cooling liquid storage chamber C221, and the other end is communicated with the input end C221*i*. The cooling liquid flowing out from the output end C221*o* of the first cooling liquid storage chamber C221 flows through the first cooling pipe 411, the third cooling pipe 413 and the second cooling pipe 412 successively, and finally flows back to the shared first cooling liquid storage chamber C221 through the input end C221*i*.

For example, one end of the inversion cooling passage 451 is communicated with the output end C221*o* of the shared first cooling liquid storage chamber C221, and the other end is communicated with the input end C221*i*. The cooling liquid flowing out from the output end C221*o* of the first cooling liquid storage chamber C221 cools the inversion device 3 when flowing by the inversion cooling passage 451, and finally flows back to the shared first cooling liquid storage chamber C221 via the input end C221*i*.

It should be noted that the flowing direction of the cooling liquid shown in the drawings is only schematic, and in the practical production, the cooling liquid may also flow in other direction, for example an opposite direction, which is not limited by the embodiment of the present disclosure.

For example, the shared first fan assembly C203 is disposed at one side of the shared first cooling liquid storage assembly C202 away from the housing 12. The shared first fan assembly C203 includes a shared first heat dissipating fan C204 and a shared first heat dissipating electric motor 205.

For example, the shared first heat dissipating electric motor C205 is disposed at one side of the shared first cooling liquid storage chamber C221 away from the housing 12, and the shared first heat dissipating fan C204 is located between the shared first heat dissipating electric motor C205 and the shared first cooling liquid storage chamber C221. When the shared first heat dissipating electric motor C205 works, the impeller of the shared first heat dissipating fan C204 is driven to rotate, and the wind generated by the rotation of the impeller is used to cool the cooling liquid in the shared first cooling liquid storage chamber C221.

FIG. 12 only illustrates four shared first fan assemblies C203. It should be understood that the total number of the shared first fan assemblies C203 may be one or more. The specific total number of the shared first fan assemblies 203 may be determined by the ordinary skilled in the art according to an area of the shared first cooling liquid storage chamber C221, which is not limited by the embodiment of the present disclosure.

In the variable-speed integrated machine provided by the above embodiment, the inversion device 3, the inversion cooling plate 441, the shared first cooling liquid storage assembly C202 and the shared first fan assembly C203 all are disposed on the same side of the housing 12. By adopting the above arrangement, the space occupied by the driving heat dissipating device, the inversion device and the inversion heat dissipating device on the variable-speed integrated machine is reduced, so that the overall size of the variable-speed integrated machine is reduced.

In the variable-speed integrated machine provided by the above embodiments, by providing the shared first cooling liquid storage assembly C202 and the shared first fan assembly C203, the total volume of the driving heat dissipating device and the inversion heat dissipating device is reduced in comparison with the case in which the driving device and the inversion device have individual dissipating device, so that the two heat dissipating devices are more compact in structure, and the overall explosion-proof function of the variable-speed integrated machine is improved.

In at least some embodiments, the first cooling passage 401 disposed in the electric motor 10 and the inversion cooling passage 415 disposed in the inversion cooling plate 441 may be connected in parallel or in series. The connection way may be determined by the ordinary skilled in the prior art according to the practical need. The two connection ways are described below in conjunction with specific examples.

FIG. 14 to FIG. 19 schematically illustrate connection block diagrams of examples in which a first cooling passage and an inversion cooling passage are connected to each other in parallel.

As shown in FIG. 14 to FIG. 19, the first cooling passage 401 includes a first cooling passage inlet 401*i* and a first cooling passage outlet 401*o*. The first cooling passage inlet 401*i* is connected with the output end 221*o* of the shared first cooling liquid storage chamber C221. The first cooling passage outlet 4010 is connected with the input end 221*i*. The cooling liquid flows out from the output end C221*o* of the shared first cooling liquid storage chamber C221 and enters the first cooling passage 401. When the cooling liquid passes through the electric motor 10, the electric motor 10 is cooled down. Finally, the cooling liquid flows back to the shared first cooling liquid storage chamber C221 via the input end C221*i*.

As shown in FIG. 14 to FIG. 19, the inversion cooling passage 451 includes an inversion cooling passage inlet 451*i* and an inversion cooling passage outlet 451*o*. The inversion cooling passage inlet 451*i* is connected with the output end C221*o* of the shared first cooling liquid storage chamber C221. The inversion cooling passage outlet 4510 is connected with the input end C221*i*. The cooling liquid flows out from the output end C221*o* of the shared first cooling liquid storage chamber C221 and enters the inversion cooling passage 451. When the cooling liquid passes through the inversion cooling plate 441, the inversion device 3 is cooled down. Finally, the cooling liquid flows back to the shared first cooling liquid storage chamber C221 via the input end C221*i*.

As shown in FIG. 14 to FIG. 19, the shared first fan assembly utilizes the wind generated by the rotation of the impeller to cool the cooling liquid flowing back into the shared first cooling liquid storage chamber C221 (as shown by an arrow of a "wind path" in the drawing).

In the variable-speed integrated machine provided by the above embodiment, the first cooling passage 401 and the inversion cooling passage 451 are configured as being in parallel connection, so that the damage of one cooling passage does not affect the normal work of the other cooling passage, and the maintenance or replacement is also facilitated.

In at least some embodiments, in order to improve the flow capacity of the cooling liquid in the inversion cooling passage and the first cooling passage and to enhance the circulating reflux effect, one or more pumps may be provided on the first cooling passage 401 and the inversion cooling passage 451.

Figure 14:
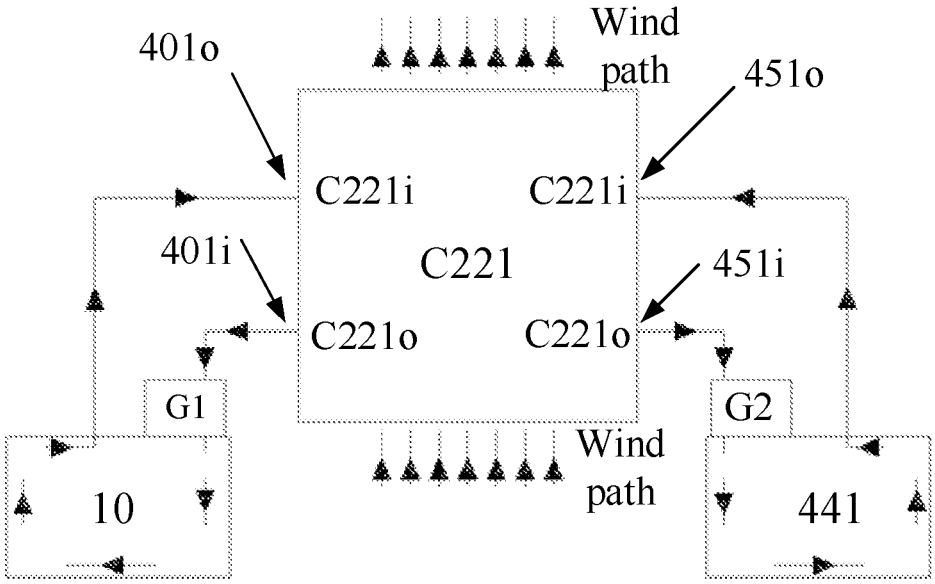
FIG. 14 to FIG. 19 schematically illustrate connection block diagrams of examples in which a first cooling passage and an inversion cooling passage are connected to each other in parallel.

As shown in FIG. 14, for example, the first cooling passage 401 and the inversion cooling passage 451 are provided respectively with a first pump G1 and a second pump G2. The first pump G1 is located on a portion of the first cooling passage 401 between the output end C221*o* and the electric motor 10 and at the upstream of the electric motor 10, so that the flow capacity of the cooling liquid in the first cooling passage is increased. The second pump G2 is located on a portion of the inversion cooling passage 451 between the output end C221*o* and the inversion cooling plate 441 and at the upstream of the inversion cooling plate 441, so that the flow capacity of the cooling liquid in the inversion cooling passage 451 is increased.

Figure 15:
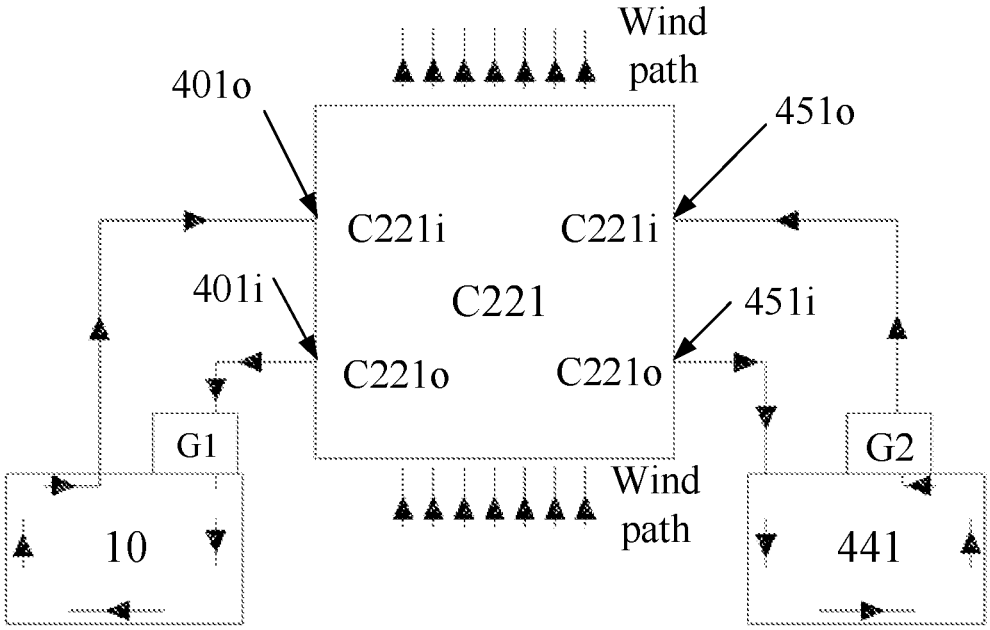

As shown in FIG. 15, for example, the first cooling passage 401 and the inversion cooling passage 451 are provided respectively with the first pump G1 and the second pump G2. The first pump G1 is located on a portion of the first cooling passage 401 between the output end C221*o* and the electric motor 10 and at the upstream of the electric motor 10, so that the flow capacity of the cooling liquid in the first cooling passage is increased. The second pump G2 is located on a portion of the inversion cooling passage 451 between the input end C221*i* and the inversion cooling plate 441 and at the downstream of the inversion cooling plate 441, so that the flow capacity of the cooling liquid in the inversion cooling passage 451 is increased.

Figure 16:
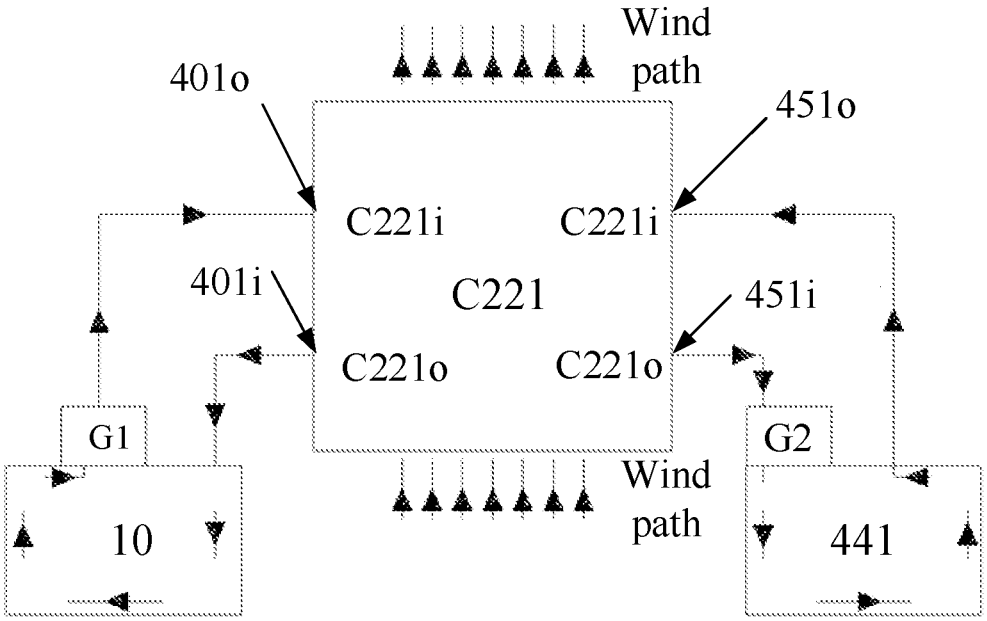

As shown in FIG. 16, for example, the first cooling passage 401 and the inversion cooling passage 451 are provided respectively with a first pump G1 and a second pump G2. The first pump G1 is located on a portion of the first cooling passage 401 between the input end C221*i* and the electric motor 10 and at the downstream of the electric motor 10, so that the flow capacity of the cooling liquid in the first cooling passage is increased. The second pump G2 is located on a portion of the inversion cooling passage 451 between the output end C221*o* and the inversion cooling plate 441 and at the upstream of the inversion cooling plate 441, so that the flow capacity of the cooling liquid in the inversion cooling passage 451 is increased.

Figure 17:
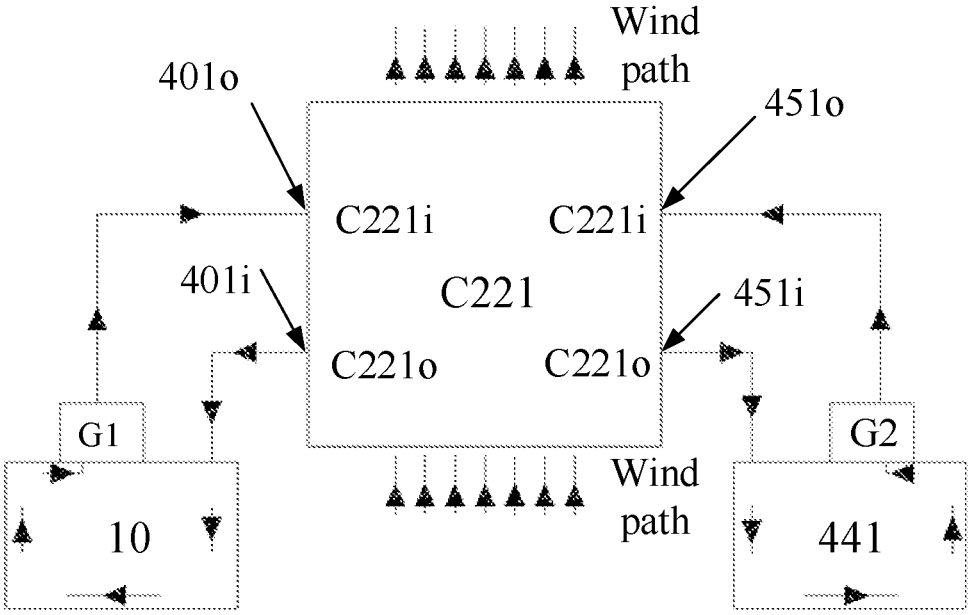

As shown in FIG. 17, for example, the first cooling passage 401 and the inversion cooling passage 451 are provided respectively with the first pump G1 and the second pump G2. The first pump G1 is located on a portion of the first cooling passage 401 between the input end C221*i* and the electric motor 10 and at the downstream of the electric motor 10, so that the flow capacity of the cooling liquid in the first cooling passage is increased. The second pump G2 is located on a portion of the inversion cooling passage 451 between the input end C221*i* and the inversion cooling plate 441 and at the downstream of the inversion cooling plate 441, so that the flow capacity of the cooling liquid in the inversion cooling passage 451 is increased.

Figure 18:
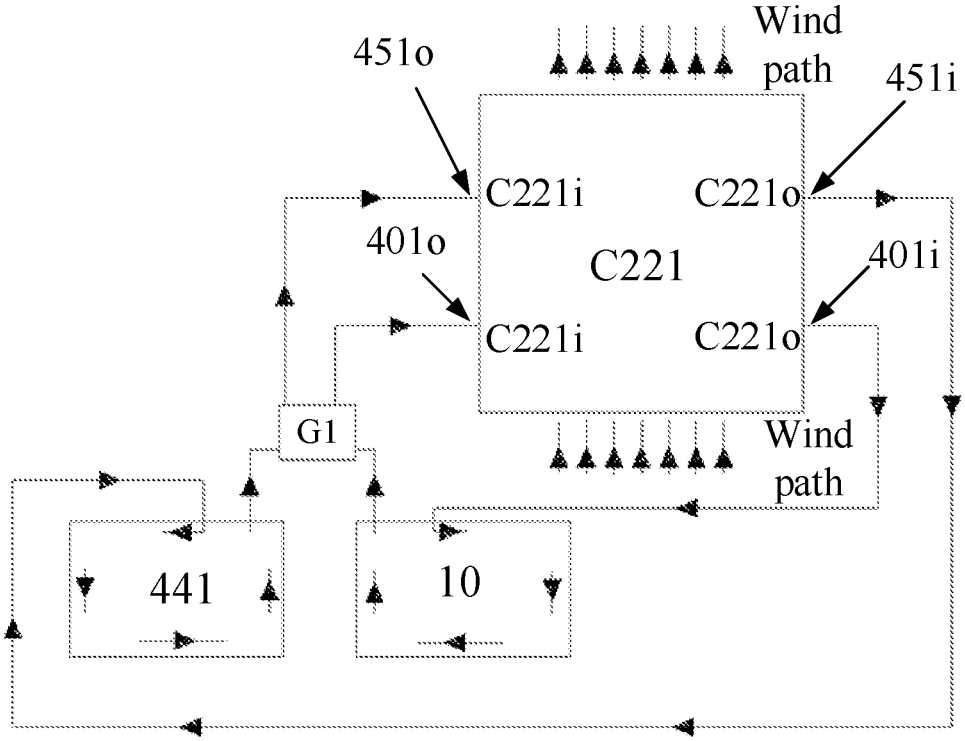

As shown in FIG. 18, for example, the first cooling passage 401 and the inversion cooling passage 451 are provided with only one first pump G1. The first pump G1 is located on a portion of the first cooling passage 401 between the input end C221*i* and the electric motor 10 and at the downstream of the electric motor 10, so that the flow capacity of the cooling liquid in the first cooling passage is increased. At the same time, the first pump G1 is also located on a portion of the inversion cooling passage 451 between the input end C221*i* and the inversion cooling plate 441 and at the downstream of the inversion cooling plate 441, so that the flow capacity of the cooling liquid in the inversion cooling passage 451 is increased.

Figure 19:
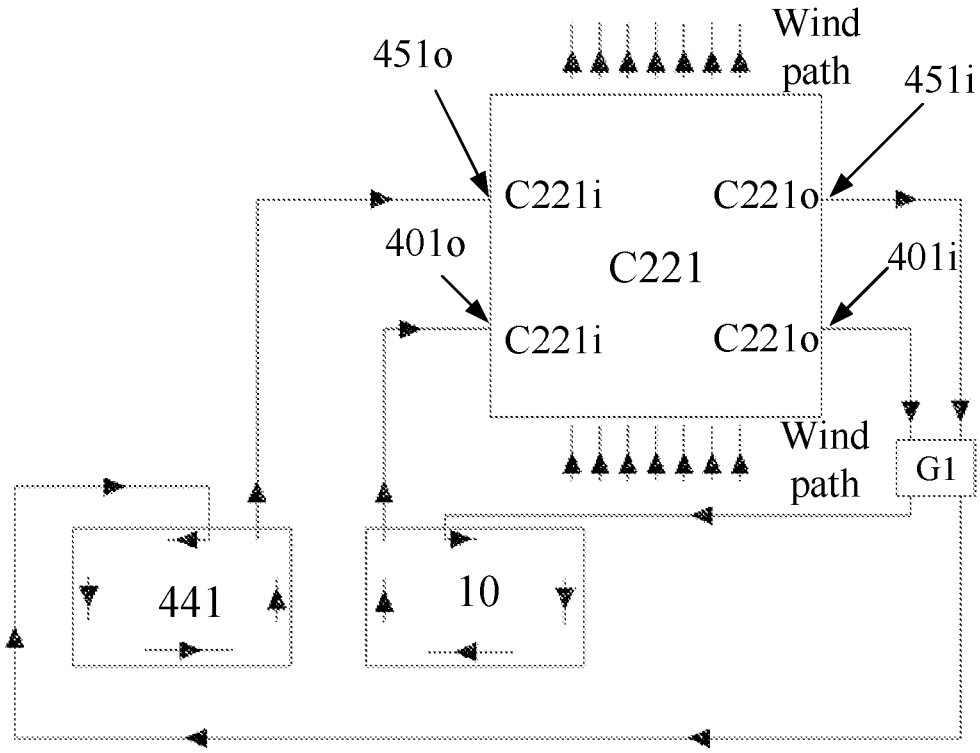

As shown in FIG. 19, for example, the first cooling passage 401 and the inversion cooling passage 451 are provided with only one first pump G1. The first pump G1 is located on a portion of the first cooling passage 401 between the output end C221*o* and the electric motor 10 and at the upstream of the electric motor 10, so that the flow capacity of the cooling liquid in the first cooling passage is increased. At the same time, the first pump G1 is also located on a portion of the inversion cooling passage 451 between the output end C221*o* and the inversion cooling plate 441 and at the upstream of the inversion cooling plate 441, so that the flow capacity of the cooling liquid in the inversion cooling passage 451 can be increased.

Compared with the case where two pumps are used in FIG. 14 to FIG. 17, only one pump is used in FIG. 18 and FIG. 19, so that the total number of the pumps used can be reduced, and the manufacturing cost can be reduced.

Figure 20:
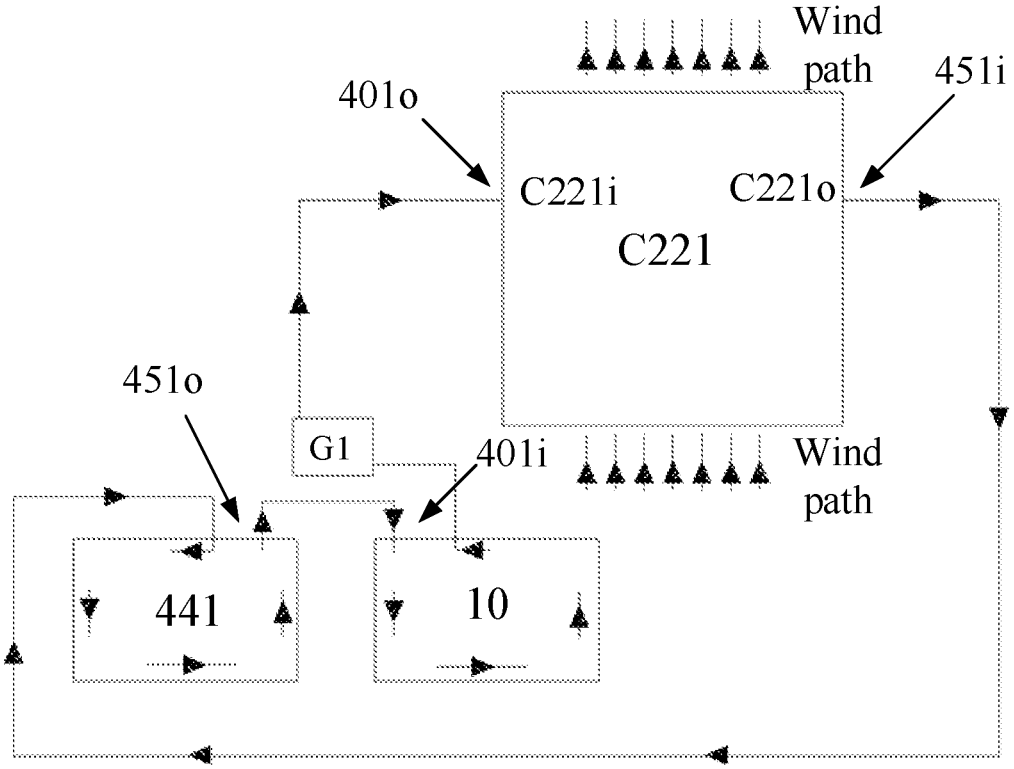
FIG. 20 and FIG. 21 schematically illustrate connection block diagrams of examples in which the first cooling passage and the inversion cooling passage are connected to each other in series.
Figure 21:
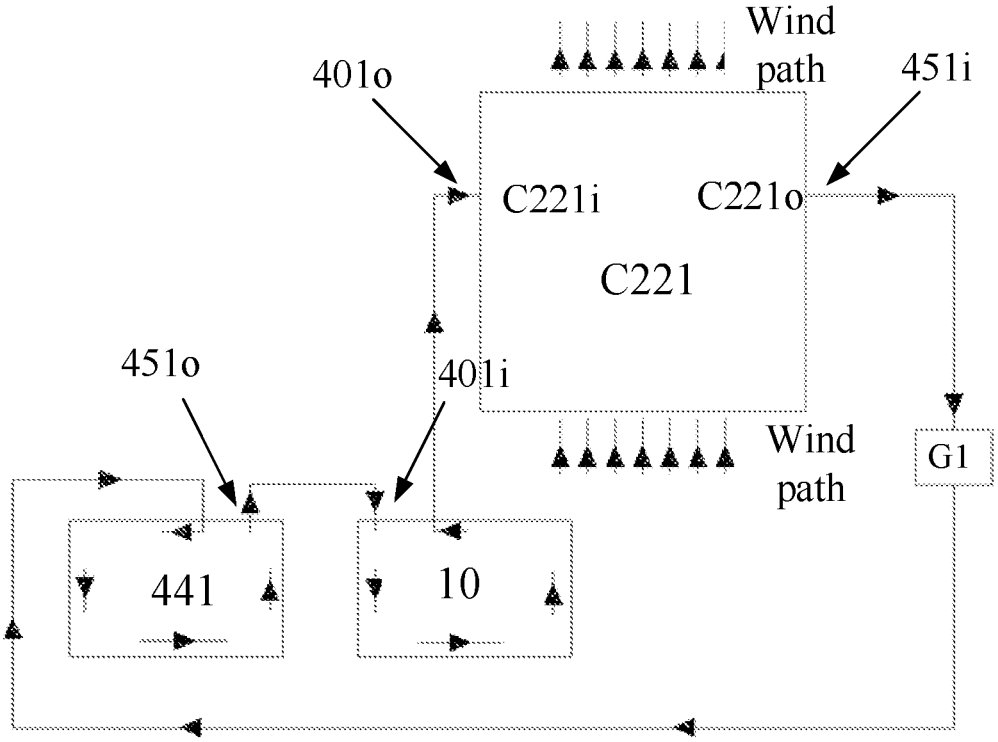

FIG. 20 and FIG. 21 schematically illustrate connection block diagrams of examples in which the first cooling passage and the inversion cooling passage are connected in series.

As shown in FIG. 20 and FIG. 21, the first cooling passage 401 includes a first cooling passage inlet 401*i* and a first cooling passage outlet 401*o*. The inversion cooling passage 451 includes an inversion cooling passage inlet 451*i* and an inversion cooling passage outlet 451*o*. The inversion cooling passage inlet 451*i* is connected with the output end C221*o* of the shared first cooling liquid storage chamber C221, the inversion cooling passage outlet 4510 is connected with the first cooling passage inlet 401*i*, and the first cooling passage outlet 4010 is connected with the input end C221*i*.

When the cooling liquid flows out from the output end C221*o* of the shared first cooling liquid storage chamber C221, the cooling liquid first enters the inversion cooling plate 441 via the inversion cooling passage 451 to cool the inversion device 3; and then the cooling liquid enters the electric motor 10 via the first cooling passage 401 to cool the electric motor 10. Finally, the cooling liquid flows back to the shared first cooling liquid storage chamber C221 via the input end C221*i*.

As shown in FIG. 20 and FIG. 21, the shared first fan assembly utilizes the wind generated by the rotation of the impeller to cool the cooling liquid flowing back into the shared first cooling liquid storage chamber (as shown by the arrow of a "wind path" in the drawing).

In FIG. 20 and FIG. 21, the cooling liquid first enters the inversion cooling passage 451 and then enters the first cooling passage 401, and it should be understood that in other embodiments the sequence of the two may be exchangeable. That is, the cooling liquid may first enter the first cooling passage 401, and then enters the inversion cooling passage 451.

When in practical production, the flowing sequence of the cooling liquid may be determined according to the heat generated by heating components. For example, the cooling liquid is first introduced into the heating component which generates less heat. If the cooling liquid is first introduced into the heating component which generates more heat, the outflow cooling liquid is high in temperature, so that the cooling liquid is impossible to cool the other heating components which generate less heat, thereby affecting the heat dissipating effect. For example, in a case where the heat generated by the electric motor is more than that generated by the inversion device, the cooling liquid first enters the inversion cooling passage 451 and then enters the first cooling passage 401, thereby avoid affecting the heat dissipating effect on the subsequent components due to the excessively high temperature of the cooling liquid.

Figure 22:
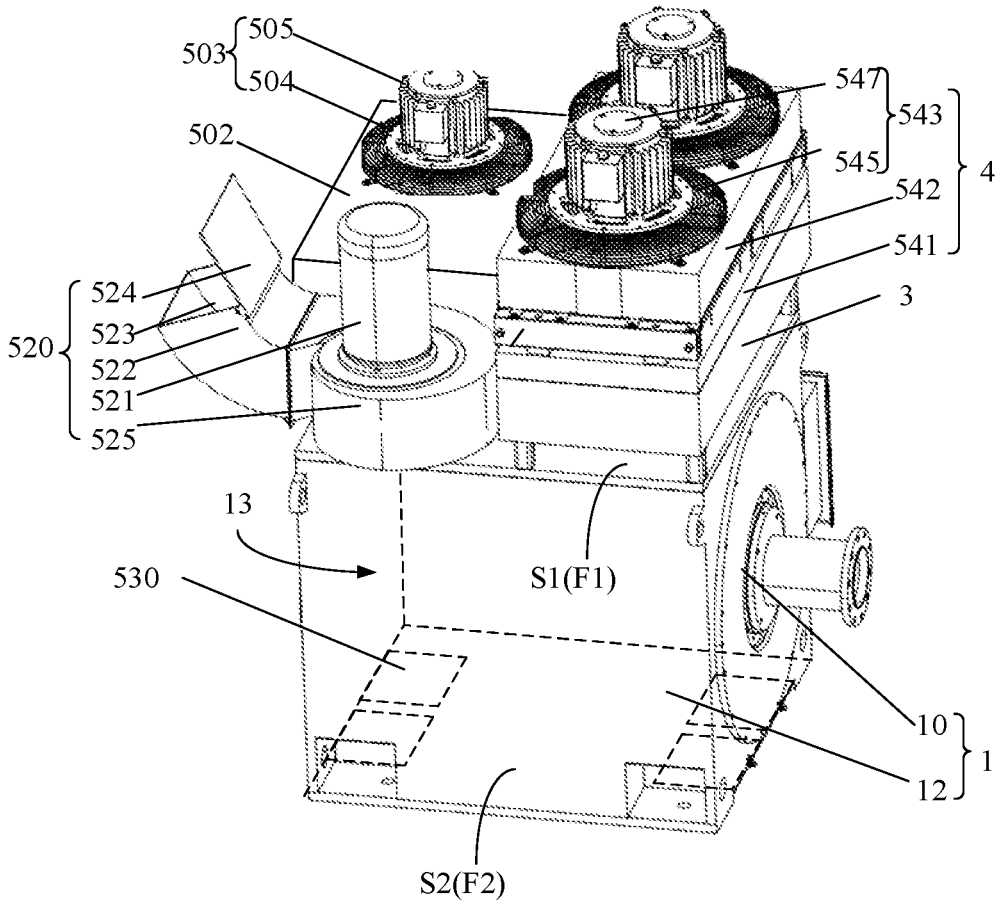
FIG. 22 is a schematically perspective view of a variable-speed integrated machine according to another embodiment of the present disclosure.

FIG. 22 is a schematically perspective view of the variable-speed integrated machine according to another embodiment of the present disclosure. As shown in FIG. 22, the variable-speed integrated machine provided by at least one embodiment of the present disclosure includes a driving device 1, a driving heat dissipating device 2, an inversion device 3 and an inversion heat dissipating device 4.

The variable-speed integrated machine in FIG. 22 differs from that in FIG. 1 in that the driving heat dissipating device 2 in FIG. 22 adopts both the air-cooling heat dissipating way and the liquid-cooling heat dissipating way to perform the heat dissipation on the driving device 1. In this case, the driving heat dissipating device 2 includes an air-cooling heat dissipating mechanism and a liquid-cooling heat dissipating mechanism.

For example, the driving device 1 includes an electric motor 10 and a housing 12 for accommodating the electric motor 10. The inversion device 3 is disposed at the first side S1, for example, on the top surface F1 of the housing, and the inversion device 3 is electrically connected with the electric motor 10. The specific structures of the electric motor 10 and the housing 12 may refer to the description of the foregoing embodiments and are not repeated here.

For example, the inversion heat dissipating device 4 is disposed at one side of the inversion device 3 away from the housing 12. The inversion heat dissipating device 4 includes an inversion cooling plate 541 (also referred to as a water cooling plate), an inversion cooling liquid storage assembly 542 and an inversion fan assembly 543. The inversion fan assembly 543 includes a heat dissipating fan 545 and a heat dissipating electric motor 547. The specific structures and arrangement of the inversion device 3, the inversion cooling plate 541, the inversion cooling liquid storage assembly 542, the inversion fan assembly 543, the heat dissipating fan 545 and the heat dissipating electric motor 547 may refer to the foregoing relevant description of the inversion device 3, the inversion cooling plate 41, the inversion cooling liquid storage assembly 42, the inversion fan assembly 43, the heat dissipating fan 45 and the heat dissipating electric motor 47, which are not repeated here.

For example, the air-cooling heat dissipating mechanism includes an air-output assembly 520 and an air-input assembly 530. For example, the air-output assembly 520 is communicated with the cavity 13 and disposed at the first side S1 of the housing 12. The air-output assembly 520 includes a heat dissipating fan 521, an exhaust-air duct 522 and a fan volute 525, wherein the exhaust-air duct 522 includes an air outlet 523 and an air-outlet cover plate 524. The air-input assembly 530, for example, is disposed at the second side S2 of the housing 12. The specific structures and arrangement of the air-output assembly 520 and the air-input assembly 530 may refer to the foregoing relevant description of the air-output assembly 20 and the air-input assembly 30 in FIG. 1, which are not repeated here.

It should be noted that in order to reserve a space for the liquid-cooling heat dissipating mechanism, the air-cooling heat dissipating mechanism in FIG. 22 adopts only one air-output assembly 520, so that the occupied area on the top surface F1 of the housing 12 can be reduced. It may be understood that the air-output direction of the air-output assembly 520 is not limited to the direction shown in the drawing.

For example, the liquid-cooling heat dissipating mechanism includes a first cooling assembly (not shown), a first cooling liquid storage assembly 502 and a first fan assembly 503. The specific structures and arrangement of the first cooling assembly, the first cooling liquid storage assembly 502 and the first fan assembly 503 may refer to the foregoing relevant description of the first cooling assembly, the first cooling liquid storage assembly 202 and the first fan assembly 203 in FIG. 9 and are not repeated here.

It should be noted that compared with the first cooling liquid storage assembly 202 in FIG. 9, the space occupied by the first cooling liquid storage assembly 502 on the top surface F1 of the housing 12 in FIG. 22 is relatively small, which is beneficial for the air-output assembly 520 to be disposed on the top surface F1 at the same time.

In at least some embodiments, at least one portion of the air-cooling heat dissipating mechanism, at least one portion of the liquid-cooling heat dissipating mechanism and the inversion device all are disposed on the same side of the housing. For example, as shown in FIG. 22, the air-output assembly 520, the first cooling liquid storage assembly 502, the first fan assembly 503 and the inversion device 3 all are disposed on the same side of the housing 12 (such as the first side S1 of the housing 12 shown in the drawing). The air-output assembly 520, the first cooling liquid storage assembly 502, the first fan assembly 503 and the inversion device 3 all are disposed on the same side of the housing 12, which saves the space occupied by the driving heat dissipating device, the inversion device 3 and the inversion heat dissipating device 4 on the variable-speed integrated machine, so that the overall size of the variable-speed integrated machine is reduced.

In the variable-speed integrated machine provided by the above embodiment, the air-cooling heat dissipating way and the liquid-cooling heat dissipating way are used simultaneously to perform the heat dissipation on the electric motor 10, thereby improving the heat dissipating effect on the electric motor. Especially for the high-power apparatus such as the electric motor, a great amount of heat may be generated during the operation, so that the normal work of the variable-speed integrated machine is further ensured by increasing the heat dissipating effect.

For example, the electric motor 10 in FIG. 22 includes an output shaft, a stator and a rotor, wherein the output shaft extends outwardly from the housing 12. The specific structures of the output shaft, the stator and the rotor and the arrangement thereof in the driving device may refer to the description of the foregoing embodiments and are not repeated here.

For example, when the air-cooling heat dissipating way and the liquid-cooling heat dissipating way are used simultaneously to perform the heat dissipation on the electric motor 10, the air-cooling heat dissipating way may be used for the rotor, and the liquid-cooling heat dissipating way may be used for the stator.

For example, in FIG. 22, when the heat dissipating fan 521 is started, the external air is sucked into the cavity 13 by the air-input assembly 30 on the bottom surface F2 of the housing 12, and the air sucked into the cavity 13 pass through the inner cavity 150 (as shown in FIG. 11) of the stator 15, thereby realizing the heat dissipating effect on the electric motor 10. Thereafter, through the pumping effect of the heat dissipating fan 521, the air is discharged from the exhaust-air duct 522.

For example, the first cooling assembly in FIG. 22 includes a first cooling passage 201 in FIG. 10 and FIG. 11, and at least one portion of the first cooling passage 201 is disposed in the stator in a direction parallel to the output shaft. In this way, when the cooling liquid is introduced into the first cooling passage, the cooling liquid flows through a stator body to realize the heat dissipating effect on the stator.

In at least some embodiments, in the case that the air-cooling heat dissipating way and the liquid-cooling heat dissipating way are used simultaneously to perform the heat dissipation on the electric motor 10, the inversion heat dissipating device 4 and the driving heat dissipating device 3 may share the first cooling liquid storage assembly 502 and the first fan assembly 503. The specific structures and arrangement of the first cooling liquid storage assembly 502, the first fan assembly 503, the inversion device 3 and the inversion heat dissipating device 4 in the shared state may refer to the foregoing relevant description in FIG. 12 and FIG. 13 and are not repeated here.

Further, in a case where the first cooling liquid storage assembly 502 and the first fan assembly 503 are shared, the first cooling passage disposed in the electric motor 10 and the inversion cooling passage disposed in the inversion cooling plate may be connected in parallel or in series. The connection way may be determined by the ordinary skilled in the prior art according to the practical need. The two connection ways are described below in conjunction with specific examples.

Figure 23:
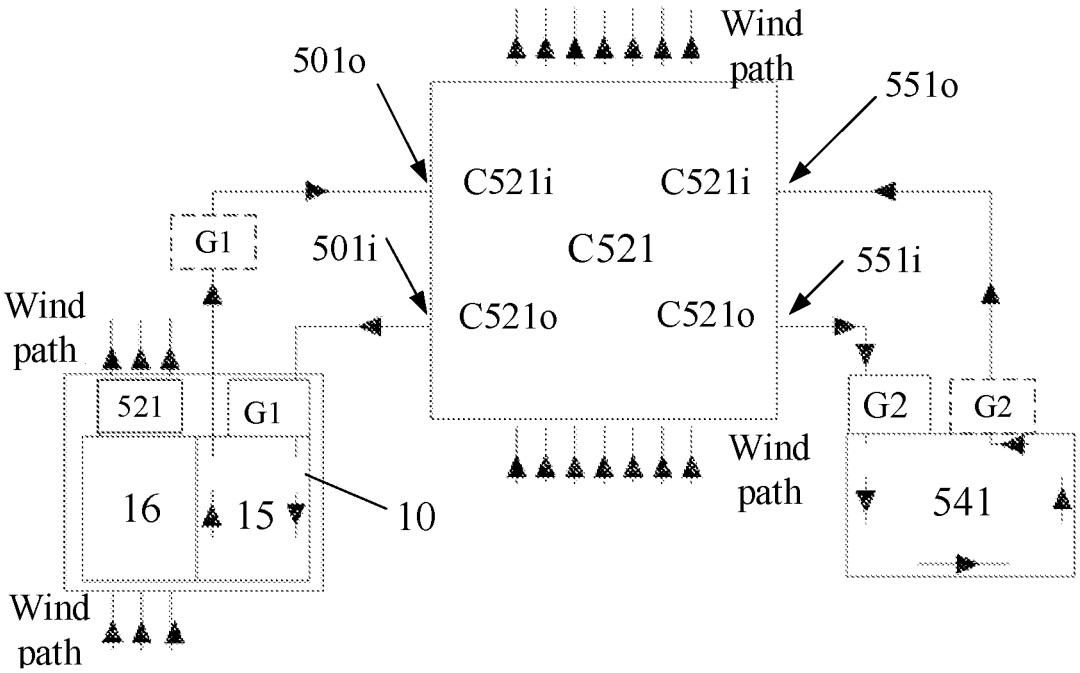
FIG. 23 to FIG. 24 schematically illustrate connection block diagrams of examples in which the first cooling passage and the inversion cooling passage are connected in parallel in the case that an air-cooling heat dissipating way and a liquid-cooling heat dissipating way are simultaneously adopted to perform heat dissipation on an electric motor.
Figure 24:
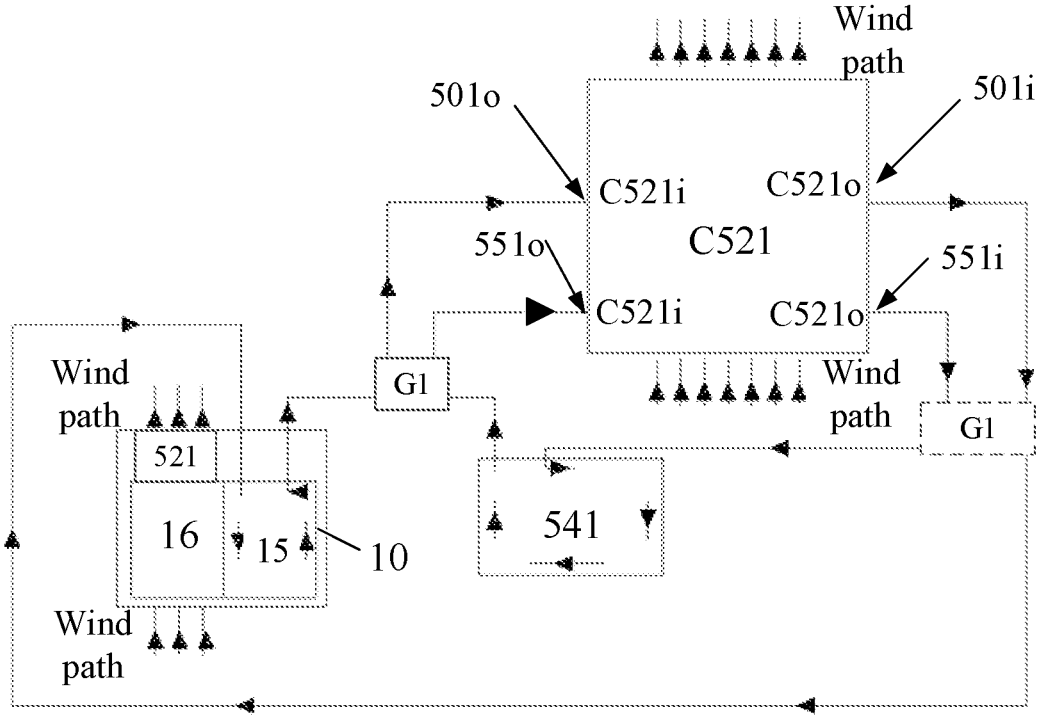

FIG. 23 to FIG. 24 schematically illustrate connection block diagrams of examples in which the first cooling passage and the inversion cooling passage are connected in parallel when the air-cooling heat dissipating way and the liquid-cooling heat dissipating way are used simultaneously to perform the heat dissipation on the electric motor.

As shown in FIG. 23 and FIG. 24, in a case where the first cooling liquid storage assembly and the first fan assembly are shared, a first cooling passage 501 is provided in the electric motor 10 of FIG. 22, and an inversion cooling passage 551 is provided in the inversion cooling plate 541 of FIG. 22. The specific structures and arrangement of the first cooling passage 501 and the inversion cooling passage 541 may refer to the foregoing description of the first cooling passage 401 and the inversion cooling passage 441 and are not repeated here.

For example, the shared first cooling liquid storage assembly includes a shared first cooling liquid storage chamber represented by C521, and the specific structures of the shared first cooling liquid storage chamber C521 and the shared first fan assembly may refer to the foregoing relevant description of the shared first cooling liquid storage chamber C221 and the shared first fan assembly C203 and are not repeated here.

As shown in FIG. 23 and FIG. 24, the first cooling passage 501 includes a first cooling passage inlet 501*i* and a first cooling passage outlet 501*o*. The first cooling passage inlet 501*i* is communicated with the output end C521*o* of the shared first cooling liquid storage chamber C521. The first cooling passage outlet 5010 is communicated with the input end C521*i*. The cooling liquid flows out from the output end C521*o* of the shared first cooling liquid storage chamber C521 and enters the first cooling passage 501. When the cooling liquid passes through the stator 15 of the electric motor 10, the stator 15 of the electric motor 10 is cooled down. Finally, the cooling liquid flows back to the shared first cooling liquid storage chamber C521 via the input end C521*i*.

As shown in FIG. 23 and FIG. 24, the inversion cooling passage 551 includes an inversion cooling passage inlet 551*i* and an inversion cooling passage outlet 551*o*. The inversion cooling passage inlet 551*i* is communicated with the output end C521*o* of the shared first cooling liquid storage chamber C521. The inversion cooling passage outlet 5510 is communicated with the input end C521*i*. The cooling liquid flows out from the output end C521*o* of the shared first cooling liquid storage chamber C521 and enters the inversion cooling passage 551. When the cooling liquid passes through the inversion cooling plate 541, the inversion device 3 is cooled down. Finally, the cooling liquid flows back to the shared first cooling liquid storage chamber C521 via the input end C521*i*.

As shown in FIG. 23 and FIG. 24, the shared first fan assembly utilizes the wind generated by the rotation of the impeller to cool the cooling liquid flowing back into the shared first cooling liquid storage chamber C521 (as shown by the arrow of the "wind path" throughout C521 in the drawing). At the same time, due to the pumping effect of the heat dissipating fan 521 in the air-output assembly 520, the external air is sucked into the electric motor 10 and pass through the rotor 16 to flow out from the exhaust-air duct 522, thereby realizing the cooling effect on the rotor 16 of the electric motor 10 (as shown by the arrow of the "wind path" throughout the rotor 6).

In at least some embodiments, in order to increase the flow capacity of the cooling liquid in the inversion cooling passage and the first cooling passage and to enhance the circulating reflux effect, one or more pumps may be provided on the first cooling passage 501 and the inversion cooling passage 551.

For example, as shown in FIG. 23, the first cooling passage 501 and the inversion cooling passage 551 are provided respectively with a first pump G1 and a second pump G2. The first pump G1 is located on a portion of the first cooling passage 501 between the output end C521*o* and the electric motor 10 and at the upstream of the electric motor 10, so that the flow capacity of the cooling liquid in the first cooling passage is increased. The second pump G2 is located on a portion of the inversion cooling passage 551 between the output end C521*o* and the inversion cooling plate 541 and at the upstream of the inversion cooling plate 541, so that the flow capacity of the cooling liquid in the inversion cooling passage 551 is increased.

For example, the first pump G1 may also be disposed on a dotted box position marked with G1 in FIG. 23, and the second pump G2 may also be disposed on a dotted box position marked with G2 in FIG. 23. The specific positions may refer to relevant description in FIG. 15 to FIG. 17, and are not repeated here.

For example, as shown in FIG. 24, the first cooling passage 501 and the inversion cooling passage 551 are provided with only one first pump G1. The first pump G1 is located on a portion of the first cooling passage 501 between the input end C521*i* and the electric motor 10 and at the downstream of the electric motor 10, so that the flow capacity of the cooling liquid in the first cooling passage is increased. At the same time, the first pump G1 is also located on a portion of the inversion cooling passage 551 between the input end C521*i* and the inversion cooling plate 541 and at the downstream of the inversion cooling plate 541, so that the flow capacity of the cooling liquid in the inversion cooling passage 551 is increased. Compared with the case where two pumps are used, by adopting one pump, the total number of the pumps used can be reduced, and the manufacturing cost can be reduced.

For example, the first pump G1 may also be disposed on a dotted box position marked with G1 in FIG. 24. The specific position may refer to relevant description in FIG. 19, and is not repeated here.

Figure 25:
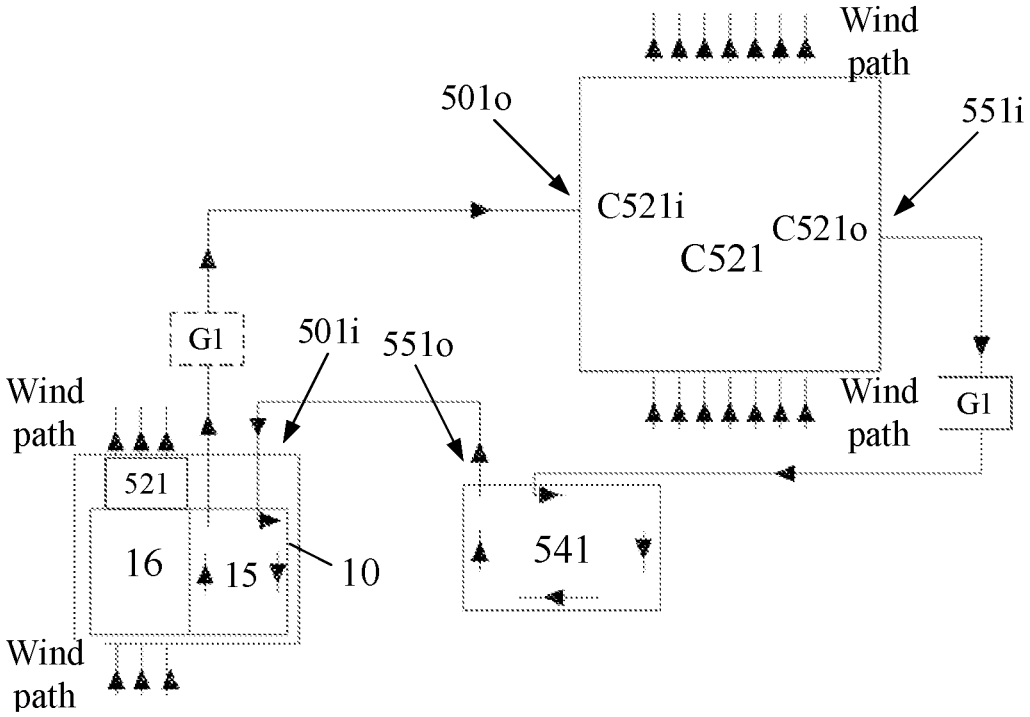
FIG. 25 schematically illustrates a connection block diagram of an example in which the first cooling passage and the inversion cooling passage are connected in series in the case that the air-cooling heat dissipating way and the liquid-cooling heat dissipating way are simultaneously adopted to perform heat dissipation on the electric motor.

FIG. 25 schematically illustrates a connection block diagram of an example in which the first cooling passage and the inversion cooling passage are connected in series when the air-cooling heat dissipating way and the liquid-cooling heat dissipating way are used simultaneously to perform the heat dissipation on the electric motor.

As shown in FIG. 25, the first cooling passage 501 includes a first cooling passage inlet 501*i* and a first cooling passage outlet 501*o*. The inversion cooling passage 551 includes an inversion cooling passage inlet 551*i* and an inversion cooling passage outlet 551*o*. The inversion cooling passage inlet 551*i* is communicated with the output end C521*o* of the shared first cooling liquid storage chamber C521, the inversion cooling passage outlet 5510 is communicated with the first cooling passage inlet 501*i*, and the first cooling passage outlet 5010 is communicated with the input end C521*i*.

When the cooling liquid flows out from the output end C521*o* of the shared first cooling liquid storage chamber C521, the cooling liquid first enters the inversion cooling plate 541 via the inversion cooling passage 551 to cool down the inversion device 3; and then the cooling liquid enters the stator 15 of the electric motor 10 via the first cooling passage 501 to cool down the stator 15 of the electric motor 10. Finally, the cooling liquid flows back to the shared first cooling liquid storage chamber C521 via the input end C521*i*.

In an example of FIG. 25, the cooling liquid first enters the inversion cooling passage 551 and then enters the first cooling passage 501, and it should be understood that in other embodiments the sequence of the two may be exchangeable. That is, the cooling liquid may first enter the first cooling passage 501, and then enter the inversion cooling passage 551. When in practical production, the specific flowing sequence of the cooling liquid in the two may be determined according to the heat generated by heating components, and more details may refer to the foregoing description.

For example, the first pump G1 may also be disposed on a dotted box position marked with G1 in FIG. 25. The specific position may refer to relevant description in FIG. 20, and is not repeated here.

At least one embodiment of the present disclosure further provides wellsite apparatus, which includes a variable-speed integrated machine according to any one of the foregoing embodiments. The wellsite apparatus includes at least one selected from the group of the electric-driven fracturing apparatus and the electric-driven cementing apparatus.

Figure 26:
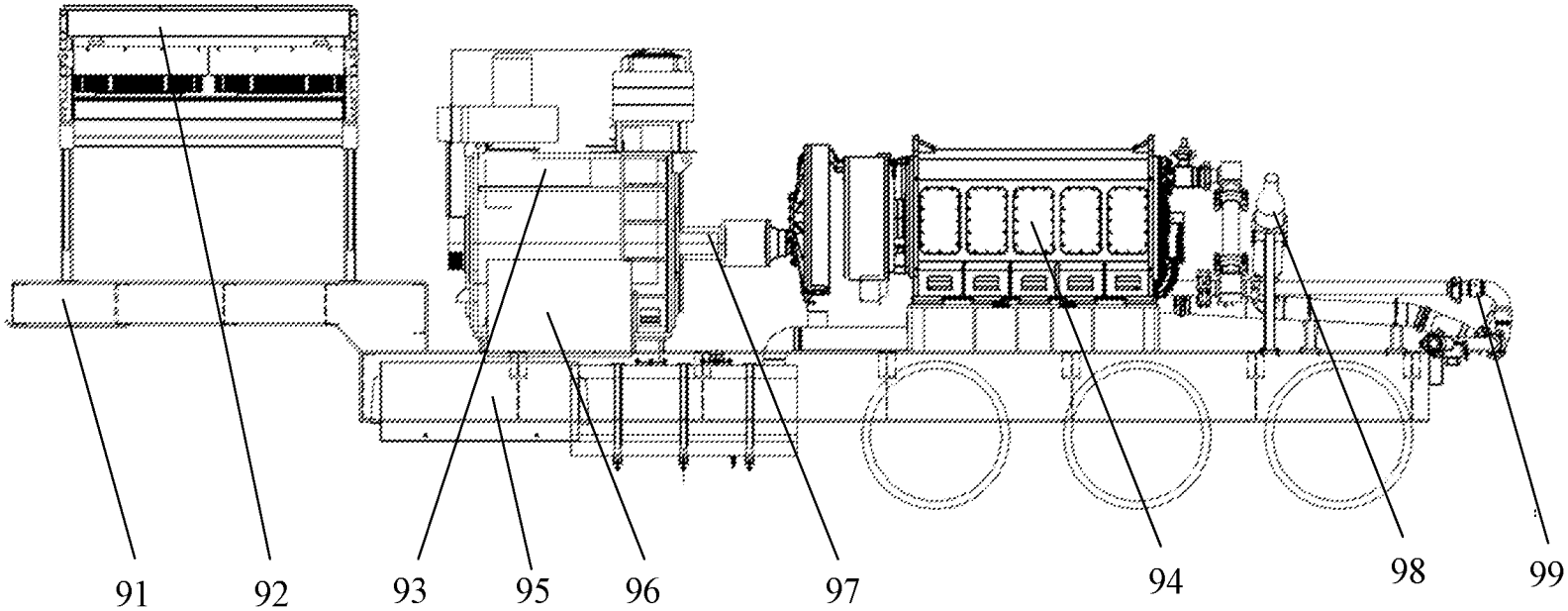
FIG. 26 is a structurally schematic diagram of an electric-driven fracturing apparatus according to an embodiment of the present disclosure.

FIG. 26 is a structurally schematic diagram of electric-driven fracturing apparatus according to an embodiment of the present disclosure. As shown in FIG. 26, for example, the electric-driven fracturing apparatus provided by at least one embodiment of the present disclosure is an electric-driven fracturing semitrailer. The electric-driven fracturing semitrailer includes a semitrailer body 91, a heat radiator 92, a variable-speed integrated machine 93, a piston pump 94, a junction box 95, a local control cabinet 96, a transmission gear 97, a high-voltage system 98 and a low-voltage system 99. The variable-speed integrated machine 93 is connected with the piston pump 94 through the transmission gear 97, and the heat radiator 92 cools down the lubricating oil of the piston pump 94.

In the electric-driven fracturing apparatus provided by the above embodiment, the variable-speed integrated machine 93 described in any one of the foregoing embodiments is applied to the electric-driven fracturing semitrailer, so that not only can the heat dissipating function for the electric motor and the inversion device be realized, but also the structure of the variable-speed integrated machine 93 is more compact, the space occupied by the variable-speed integrated machine 93 on the semitrailer is reduced, the weight of the vehicle is reduced, the manufacturing cost of the vehicle is reduced, and more flexibility in practical use and convenience in transportation can be realized.

In the electric-driven fracturing apparatus provided by the above embodiment, the electric motor and an inverter are integrated together, so that the electric-driven fracturing semitrailer may attain the working state with only one group of power cable and auxiliary cable connected to a power supply device, and the wire connection is simpler and more convenient. For example, the power provided by the power supply apparatus may be supplied with the high-voltage power rectified by the rectifier transformer and may also be supplied with the power directly rectified by a power generator.

For example, the transmission gear 97 may adopt at least one or two of a transmission shaft, a coupler or a clutch. For example, the transmission gear 97 is connected directly with the piston pump 94 and is also connected with the piston pump through a gearbox so as to realize the input of a larger torque. While the input torque of the piston pump increases, the higher discharge pressure is discharged. The gearbox includes but is not limited to a reduction gearbox, a transmission case and a transfer case.

According to different operating environments, the gearbox may be integrated with other apparatus and may also be disposed independently. For example, in the case that the gearbox is applied to the electric-driven fracturing apparatus, the gearbox is integrated into the piston pump. In the case that the gearbox is applied to the electric-driven cementing apparatus, the transmission gear and the piston pump may be provided with a multi-level gearbox, such as a two-level gearbox, so that the torque is increased by multi-level transmission and speed reduction.

For example, an axis of the coupler may overlap or not overlap an axis of the piston pump. In the case that the axes of the two are not overlapped, the coupler adopts a flexible or an elastic coupler.

For example, the piston pump 94 is a five-cylinder piston pump with power more than 5000 hp. Guarantee is provided for high-power output of a single vehicle, and the power density per unit area is also increased, thereby providing a prerequisite for reducing the occupied area of the whole wellsite.

For example, the power of the variable-speed integrated machine 93 is more than 3000 KW. The power of the variable-speed integrated machine 93 is matched with the power of the piston pump 94, so that the variable-speed integrated machine 93 can drive the piston pump 94 normally.

For example, the junction box 95 is connected with the variable-speed integrated machine 93, and the junction box 95 may be disposed on a side surface or a tail portion of the vehicle. The junction box 95 may be a cable connector connected by bolts, and may also be a quick connector. In the embodiment of the present disclosure, the electric-driven fracturing semitrailer may attain the working state only with one group of power cable and auxiliary cable connected to a power supply device, and the wire connection is simpler and more convenient.

In the variable-speed integrated machine and wellsite apparatus thereof provided by the embodiment of the present disclosure, the inversion heat dissipating device is used to perform the heat dissipation on the inversion device, and the driving heat dissipating device is used to perform the heat dissipation on the driving device, so that the consecutive work of the driving device and the inversion device at the normal temperature in the wellsite is guaranteed effectively. At least one portion of the driving heat dissipating device and the inversion device are disposed on the same side of the housing, which saves the space occupied by the driving heat dissipating device and the inversion device on the variable-speed integrated machine, so that the overall size of the variable-speed integrated machine is reduced. When the variable-speed integrated machine with a small size is applied to the wellsite apparatus, due to the small overall size of the variable-speed integrated machine, the occupied space on the wellsite apparatus is reduced, thereby providing more space for installing other apparatuses on the wellsite apparatus. When at least one portion of the driving heat dissipating device and the inversion device are disposed on the top surface of the housing, since the top space of the wellsite apparatus is occupied, the side space is not affected, so that even if the transverse distance between two wellsite apparatus is small, the heat dissipating effect of the two wellsite apparatus is not affected.

The following points need to be noted herein:

(1) The accompanying drawings of the embodiments of the present disclosure only relate to the structure involved in the embodiments of the present disclosure, and other structures may refer to the conventional design.

(2) In case of no conflict, the embodiments of the present disclosure and features in the embodiments may be combined to obtain new embodiments.

The above are only specific implementations of the present disclosure, but the protection scope of the present disclosure is not limited thereto. Any simple variations or replacements made by the ordinary skilled familiar with the prior art within the technical scope disclosed by the present disclosure shall be covered by the protection scope of the present disclosure. Therefore, the protection scope of the present disclosure should be subjected to the protection scope defined by the claims.

The invention claimed is:

1. A variable-speed integrated machine, comprising:

a driving device, comprising an electric motor and a housing configured for accommodating the electric motor;

an inversion device, disposed on an outside of the housing and electrically connected with the electric motor;

an inversion heat dissipating device, disposed at one side of the inversion device away from the housing and the electric motor accommodated therein, and configured to perform heat dissipation on the inversion device in a liquid-cooling heat dissipating way;

a driving heat dissipating device, at least one portion of the driving heat dissipating device being disposed on the outside of the housing and configured to perform heat dissipation on the driving device, wherein the driving heat dissipating device comprises an air-cooling heat dissipating mechanism, the air-cooling heat dissipating mechanism comprises an air outlet facing a direction away from the inversion device;

wherein the air-cooling heat dissipating mechanism is configured to suction air into the housing and discharge the air through the air outlet, and the inversion device is not in a path of air flow;

wherein the inversion device and at least one portion of the driving heat dissipating device are disposed on a same side of the housing;

wherein the housing defines a cavity, the cavity is configured to accommodate the electric motor, the air-cooling heat dissipating mechanism further comprises an air-output assembly communicated with the cavity, and the air-output assembly and the inversion device are disposed on the same side of the housing;

wherein the electric motor comprises an output shaft, the output shaft extends out from the housing, the housing comprises a first side and a second side opposite to each other and the first and second sides are both parallel to the output shaft, the air-output assembly and the inversion device are disposed on the first side;

wherein the air-cooling heat dissipating mechanism further comprises an air-input assembly, the air-input assembly comprises an air inlet disposed on the second side of the housing, the air inlet is configured as being communicated with the cavity, such that the air entering the cavity from the air inlet is discharged from the air-output assembly after passing through the electric motor.

2. The variable-speed integrated machine according to claim 1, wherein the air-cooling heat dissipating mechanism comprises at least two air-output assemblies, and the at least two air-output assemblies have same air-output direction or different air-output directions.

3. The variable-speed integrated machine according to claim 1, wherein the air-output assembly comprises:

a heat dissipating fan, disposed on the housing;

a fan volute, disposed between the heat dissipating fan and the housing; and an exhaust-air duct, wherein a first side of the fan volute is communicated with the heat dissipating fan, a second side of the fan volute is communicated with the cavity, a third side of the fan volute is communicated with the exhaust-air duct, the electric motor comprises an output shaft, and the first side and the second side are opposite to each other and the first and second sides are both parallel to the output shaft, and wherein the heat dissipating fan is configured to suction air in the cavity into the fan volute, and the air is discharged through the exhaust-air duct.

4. The variable-speed integrated machine according to claim 3, wherein the exhaust-air duct comprises an air-outlet cover plate, rotatably connected to the air outlet and configured to cover the air outlet; and wherein the air outlet faces away from the housing.

5. The variable-speed integrated machine according to claim 1, wherein the air-input assembly comprises:

a groove, disposed at the second side of the housing, wherein the air inlet is disposed in the groove; and a protection mesh, covering the air inlet, wherein a plane where the protection mesh is located is not coplanar with an outer surface of the second side of the housing, and the plane where the protection mesh is closer to the electric motor than the outer surface of the second side of the housing.

6. The variable-speed integrated machine according to claim 1, wherein the driving heat dissipating device comprises: a liquid-cooling heat dissipating mechanism, the liquid-cooling heat dissipating mechanism comprises:

a first cooling assembly, disposed in the cavity defined by the housing, the cavity is configured to accommodate the electric motor;

a first fan assembly, disposed on the housing; and a first cooling liquid storage assembly, disposed between the first fan assembly and the housing, the first cooling liquid storage assembly is communicated with the first cooling assembly and configured to supply cooling liquid to the first cooling assembly, and the first fan assembly is configured to perform the heat dissipation on the cooling liquid in the first cooling liquid storage assembly, wherein the first cooling liquid storage assembly, the first fan assembly and the inversion device all are disposed on the same side of the housing.

7. The variable-speed integrated machine according to claim 6, wherein:

the inversion heat dissipating device and the driving heat dissipating device share the first cooling liquid storage assembly and the first fan assembly; and the inversion heat dissipating device comprises an inversion cooling plate disposed at one side of the inversion device away from the housing, the shared first fan assembly is disposed at one side of the inversion cooling plate away from the housing, and the shared first cooling liquid storage assembly is disposed between the shared first fan assembly and the inversion cooling plate.

8. The variable-speed integrated machine according to claim 7, wherein:

the electric motor comprises an output shaft, the output shaft extends out from the housing, and the housing comprises a first side and a second side opposite to each other in a direction perpendicular to the output shaft; and the shared first cooling liquid storage assembly, the shared first fan assembly, the inversion device and the inversion cooling plate all are disposed on the first side of the housing, and the inversion device covers partial or whole outer surface of the first side of the housing.

9. The variable-speed integrated machine according to claim 7, wherein the inversion heat dissipating device comprises:

an inversion cooling passage, disposed in the inversion cooling plate and comprises an inversion cooling passage inlet and an inversion cooling passage outlet, wherein the first cooling assembly comprises:

a first cooling passage, at least one portion of the first cooling passage is disposed in the electric motor, and the first cooling passage comprises a first cooling passage inlet and a first cooling passage outlet, wherein the first cooling liquid storage assembly comprises: a cooling liquid storage chamber, and the cooling liquid storage chamber comprises:

an output end, configured to output the cooling liquid to the inversion cooling passage and the first cooling passage; and an input end, configured to receive the cooling liquid flowing back from the inversion cooling passage and the first cooling passage, wherein the inversion cooling passage inlet and the first cooling passage inlet are connected with the output end respectively, and the inversion cooling passage outlet and the first cooling passage outlet are connected with the input end respectively.

10. The variable-speed integrated machine according to claim 7, wherein the inversion heat dissipating device comprises:

an inversion cooling passage, disposed in the inversion cooling plate and comprises an inversion cooling passage inlet and an inversion cooling passage outlet;

wherein the first cooling assembly comprises:

a first cooling passage, at least one portion of the first cooling passage is disposed in the electric motor, and the first cooling passage comprises a first cooling passage inlet and a first cooling passage outlet, wherein the first cooling liquid storage assembly comprises a cooling liquid storage chamber, and the cooling liquid storage chamber comprises:

an output end, configured to output the cooling liquid to the inversion cooling passage and the first cooling passage; and an input end, configured to receive the cooling liquid flowing back from the inversion cooling passage and the first cooling passage, wherein the inversion cooling passage inlet is connected with the output end, the inversion cooling passage outlet is connected with the first cooling passage inlet, and the first cooling passage outlet is connected with the input end.

11. The variable-speed integrated machine according to claim 1, wherein:

the driving heat dissipating device comprises an air-cooling heat dissipating mechanism and a liquid-cooling heat dissipating mechanism; and at least one portion of the air-cooling heat dissipating mechanism, at least one portion of the liquid-cooling heat dissipating mechanism, and the inversion device all are disposed on the same side of the housing.

12. The variable-speed integrated machine according to claim 11, wherein the housing defines a cavity, the cavity is configured to accommodate the electric motor, wherein the air-cooling heat dissipating mechanism comprises: an air-output assembly communicated with the cavity, wherein the liquid-cooling heat dissipating mechanism comprises:

a first cooling assembly, disposed in the cavity defined by the housing;

a first fan assembly, disposed on the housing; and a first cooling liquid storage assembly, disposed between the first fan assembly and the housing, the first cooling liquid storage assembly is communicated with the first cooling assembly and configured to supply cooling liquid to the first cooling assembly, and the first fan assembly is configured to perform the heat dissipation on the cooling liquid in the first cooling liquid storage assembly, wherein the air-output assembly, the first cooling liquid storage assembly, the first fan assembly, and the inversion device all are disposed on the same side of the housing.

13. The variable-speed integrated machine according to claim 12, wherein the electric motor comprises an output shaft, a stator, and a rotor, and the output shaft extends out from the housing, wherein the first cooling assembly comprises: a first cooling passage, at least one portion of the first cooling passage is disposed in the stator in a direction parallel to the output shaft, and wherein the air-cooling heat dissipating mechanism further comprises: an air-input assembly, the air-input assembly comprises an air inlet disposed on the housing, the air inlet is configured as being communicated with the cavity, such that the air entering the cavity from the air inlet passes through the rotor and is discharged from the air-output assembly.

14. The variable-speed integrated machine according to claim 12, wherein:

the inversion heat dissipating device and the driving heat dissipating device share the first cooling liquid storage assembly and the first fan assembly, and the inversion heat dissipating device comprises: an inversion cooling plate disposed at one side of the inversion device away from the housing, the shared first fan assembly is disposed at one side of the inversion cooling plate away from the housing, and the shared first cooling liquid storage assembly is disposed between the shared first fan assembly and the inversion cooling plate.

15. The variable-speed integrated machine according to claim 14, wherein the inversion heat dissipating device comprises:

an inversion cooling passage, disposed in the inversion cooling plate and comprises an inversion cooling passage inlet and an inversion cooling passage outlet, wherein the first cooling assembly comprises:

a first cooling passage, at least one portion of the first cooling passage is disposed in the electric motor, and the first cooling passage comprises a first cooling passage inlet and a first cooling passage outlet, wherein the first cooling liquid storage assembly comprises: a cooling liquid storage chamber, the cooling liquid storage chamber comprises:

an output end, configured to output the cooling liquid to the inversion cooling passage and the first cooling passage; and an input end, configured to receive the cooling liquid flowing back from the inversion cooling passage and the first cooling passage, wherein the inversion cooling passage inlet and the first cooling passage inlet are connected with the output end respectively, and the inversion cooling passage outlet and the first cooling passage outlet are connected with the input end respectively.

16. The variable-speed integrated machine according to claim 14, wherein the inversion heat dissipating device comprises:

an inversion cooling passage, disposed in the inversion cooling plate and comprises an inversion cooling passage inlet and an inversion cooling passage outlet;

wherein the first cooling assembly comprises: a first cooling passage, at least one portion of the first cooling passage is disposed in the electric motor, and the first cooling passage comprises a first cooling passage inlet and a first cooling passage outlet;

wherein the first cooling liquid storage assembly comprises: a cooling liquid storage chamber, and the cooling liquid storage chamber comprises:

an output end, configured to output the cooling liquid to the inversion cooling passage and the first cooling passage; and an input end, configured to receive the cooling liquid flowing back from the inversion cooling passage and the first cooling passage, wherein the inversion cooling passage inlet is connected with the output end, the inversion cooling passage outlet is connected with the first cooling passage inlet, and the first cooling passage outlet is connected with the input end.

17. The variable-speed integrated machine according to claim 1, wherein the electric motor comprises: a bottom and a top, wherein the housing comprises: a bottom surface on a same side as the bottom of the electric motor, and a top surface on a same side as the top of the electric motor, and wherein at least one portion of the driving heat dissipating device, the inversion device, and the inversion heat dissipating device all are disposed on the top surface of the housing.

18. A wellsite apparatus, comprising the variable-speed integrated machine according to claim 1.

* * * * *